US011821226B2

(12) United States Patent
Pescovitz

(10) Patent No.: US 11,821,226 B2
(45) Date of Patent: Nov. 21, 2023

(54) PERSONAL POP-UP PODS

(71) Applicant: Under the Weather, LLC, Cincinnati, OH (US)

(72) Inventor: Eric Pescovitz, Cincinnati, OH (US)

(73) Assignee: UNDER THE WEATHER, LLC, Cincinnati, OH (US)

( * ) Notice: Subject to any disclaimer, the term of this patent is extended or adjusted under 35 U.S.C. 154(b) by 83 days.

(21) Appl. No.: 17/605,311

(22) PCT Filed: Apr. 27, 2020

(86) PCT No.: PCT/US2020/030129

§ 371 (c)(1),
(2) Date: Oct. 21, 2021

(87) PCT Pub. No.: WO2020/220039

PCT Pub. Date: Oct. 29, 2020

(65) Prior Publication Data

US 2022/0186517 A1 Jun. 16, 2022

Related U.S. Application Data

(63) Continuation of application No. 16/394,622, filed on Apr. 25, 2019, now Pat. No. 10,895,091.
(Continued)

(51) Int. Cl.
*E04H 15/00* (2006.01)
*A61G 10/00* (2006.01)
(Continued)

(52) U.S. Cl.
CPC ..... *E04H 15/001* (2013.01); *E04H 15/405* (2013.01); *E04H 15/44* (2013.01); *A41D 7/008* (2013.01); *E04H 15/003* (2013.01)

(58) Field of Classification Search
CPC ..... A61G 10/005; A61B 90/40
See application file for complete search history.

(56) References Cited

U.S. PATENT DOCUMENTS 1,888,909 A 11/1932 Crosthwait
3,546,708 A 12/1970 Chapman
(Continued)

OTHER PUBLICATIONS

International Searching Authority, Written Opinion issued in PCT/US2020/030129 dated Aug. 10, 2020 (6 pages).
(Continued)

*Primary Examiner* — Noah Chandler Hawk
(74) *Attorney, Agent, or Firm* — Wood Herron & Evans LLP

(57) ABSTRACT

A personal pop-up pod includes an interior chamber formed by a connection of several panels: a front panel, a rear panel, left and right side panels, and a top panel. The personal pop-up pod also includes first and second arm apertures formed in the rear panel, a window in one of the side panels, and a zipper arranged to open and close the window. A bottom edge of the front panel includes an elastic strip so that the bottom edge of the front panel may closely conform around a region of a patient when the patient's head is located in the interior chamber. As such, the personal pop-up pod defines a containment that allows a patient to undergo a medical examination or medical procedure while protecting one or both of the caregiver and the patient from contamination of each other.

16 Claims, 37 Drawing Sheets

Related U.S. Application Data

(60) Provisional application No. 63/004,504, filed on Apr. 3, 2020, provisional application No. 63/001,336, filed on Mar. 29, 2020.

(51) Int. Cl.

| | |
|---|---|
| ***E04H 15/40*** | (2006.01) |
| ***E04H 15/44*** | (2006.01) |
| *A41D 7/00* | (2006.01) |

(56) References Cited

U.S. PATENT DOCUMENTS

| | | | | |
|---|---|---|---|---|
| 4,685,728 | A | 8/1987 | Rebollo | |
| 5,061,235 | A | 10/1991 | Hogan | |
| 5,101,513 | A | 4/1992 | Bowers | |
| 5,316,541 | A * | 5/1994 | Fischer | A61G 10/005 128/853 |
| 6,305,396 | B1 | 10/2001 | Zheng | |
| 7,004,539 | B1 | 2/2006 | Hansen et al. | |
| 7,137,399 | B1 | 11/2006 | Ransom et al. | |
| 8,990,967 | B2 | 3/2015 | Tallon | |
| 9,060,613 | B2 | 6/2015 | Combs | |
| 10,016,252 | B1 | 7/2018 | Wren, Sr. | |
| 10,323,435 | B2 | 6/2019 | Ferrara | |
| 2003/0037362 | A1 | 2/2003 | Dodge | |
| 2004/0159347 | A1 | 8/2004 | Brown et al. | |
| 2004/0226597 | A1 | 11/2004 | McCampbell | |
| 2004/0255526 | A1 | 12/2004 | Tremblay | |
| 2006/0169309 | A1 | 8/2006 | Brackins | |
| 2011/0174811 | A1 | 7/2011 | Sabounjian | |
| 2016/0074268 | A1 | 3/2016 | Breegi et al. | |
| 2017/0215534 | A1 | 8/2017 | Huddleston | |
| 2018/0073268 | A1 | 3/2018 | Pescovitz | |
| 2021/0307871 | A1 * | 10/2021 | Edalati | A61B 90/40 |
| 2021/0307985 | A1 * | 10/2021 | Staab | A61G 10/02 |
| 2021/0330413 | A1 * | 10/2021 | Feeley | A61B 46/23 |
| 2021/0330918 | A1 * | 10/2021 | Menezes | A61G 10/005 |
| 2021/0353481 | A1 * | 11/2021 | Susec | A61G 10/005 |
| 2021/0353483 | A1 * | 11/2021 | Moore | A61B 90/40 |

OTHER PUBLICATIONS

International Searching Authority, Search Report issued in PCT/US2020/030129 dated Aug. 10, 2020 (3 pages).

European Patent Office, Partial Supplementary European Search Report issued in EP Application No. 20795764.8-113, dated Dec. 21, 2022 (13 pages).

* cited by examiner

PERSONAL POP-UP PODS

CROSS REFERENCE TO RELATED APPLICATIONS

This application is a 371 National Phase application of PCT/US2020/030129, filed Apr. 27, 2020, which claims the priority of each of U.S. Non-Provisional patent application Ser. No. 16/394,622, filed on Apr. 25, 2019; U.S. Provisional Patent Application Ser. No. 63/001,336, filed on Mar. 29, 2020; and U.S. Non-Provisional Patent Application Ser. No. 63/004,504, filed on Apr. 3, 2020 the disclosures of which are incorporated by reference herein.

FIELD OF INVENTION

The present disclosure generally relates to personal pop-up pods. More specifically, the present disclosure relates to pop-up pods that accommodate a single user, which allows the user to remain mobile and accomplish any number of personal or occupational tasks while protecting the user from the surrounding environment.

SUMMARY

Disclosed herein are novel personal pop-up pods designed for a single user. In one embodiment, a personal pop-up pod can provide a user with privacy and/or protection from the surrounding environment. The personal pop-up pods can be designed such that a user can remain mobile, i.e., able to move from one location to another while using a personal pop-up pod. The personal pop-up pods can be designed such that a user can selectively gain access to the environment surrounding the pop-up pod by opening windows and other points of access. The personal pop-up pods can protect the user form a variety of conditions surrounding the personal pop-up pods such as, for example, rain, snow, wind, low temperatures, and other such climate related elements or communicable diseases and other such health risks.

In one embodiment, novel personal pop-up pods can be designed for a single user to protect the user from surrounding elements including protection for communicable diseases that are transmitted through the air. Additionally, the personal pop-up pod can protect persons positioned proximate to the user from an airborne communicable disease carried by the user. The personal pop-up pods can be designed for use by a medical patient or a medical professionals. The personal pop-up pods can provide the medical patient or medical professional with protection in an environment where communicable diseases are commonly transmitted through the air. A personal pop-up pods can be designed such that a patient can be fitted with the personal pop-up pod to provide said protection while allowing the medical personal access to the patient to conduct a medical examination or medical procedure, or fitted to a medical profession in a way that allows provides protection but does not interfere with the performance of the medical professional's duties.

In another embodiment, the personal pop-up pod is comprised of a continuous enclosure fitted about the patient to isolate the patient from the surrounding environment. At least one of the sides of the continuous enclosure can include one or more slots that allow a medical professional to insert his or her arms through the slots to gain access to the patient to perform a medical examination or medical procedure. The slots can be arranged such that once a medical professional inserts his or her arms through the slots, the slots engage the arms of the medical professional to seal the slots about said arms and limit or prohibit the flow of air from the interior to the exterior of the personal pop-up pod. The personal pop-up pod can optionally include a fluid port in one of the sides of the enclosure that can be connected to a vacuum pump or other negative pressure device to selectively evacuate air from the interior of the personal pop-up pod. Such a vacuum pump or negative pressure device can evacuate air from the interior of the personal pop-up pod to remove air that may contain airborne contagions capable of transmitting communicable diseases to persons proximate to the contagions. The vacuum pump or negative pressure device can include a filter capable of capturing such contagions to substantially curb the potential for transmission of communicable diseases.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
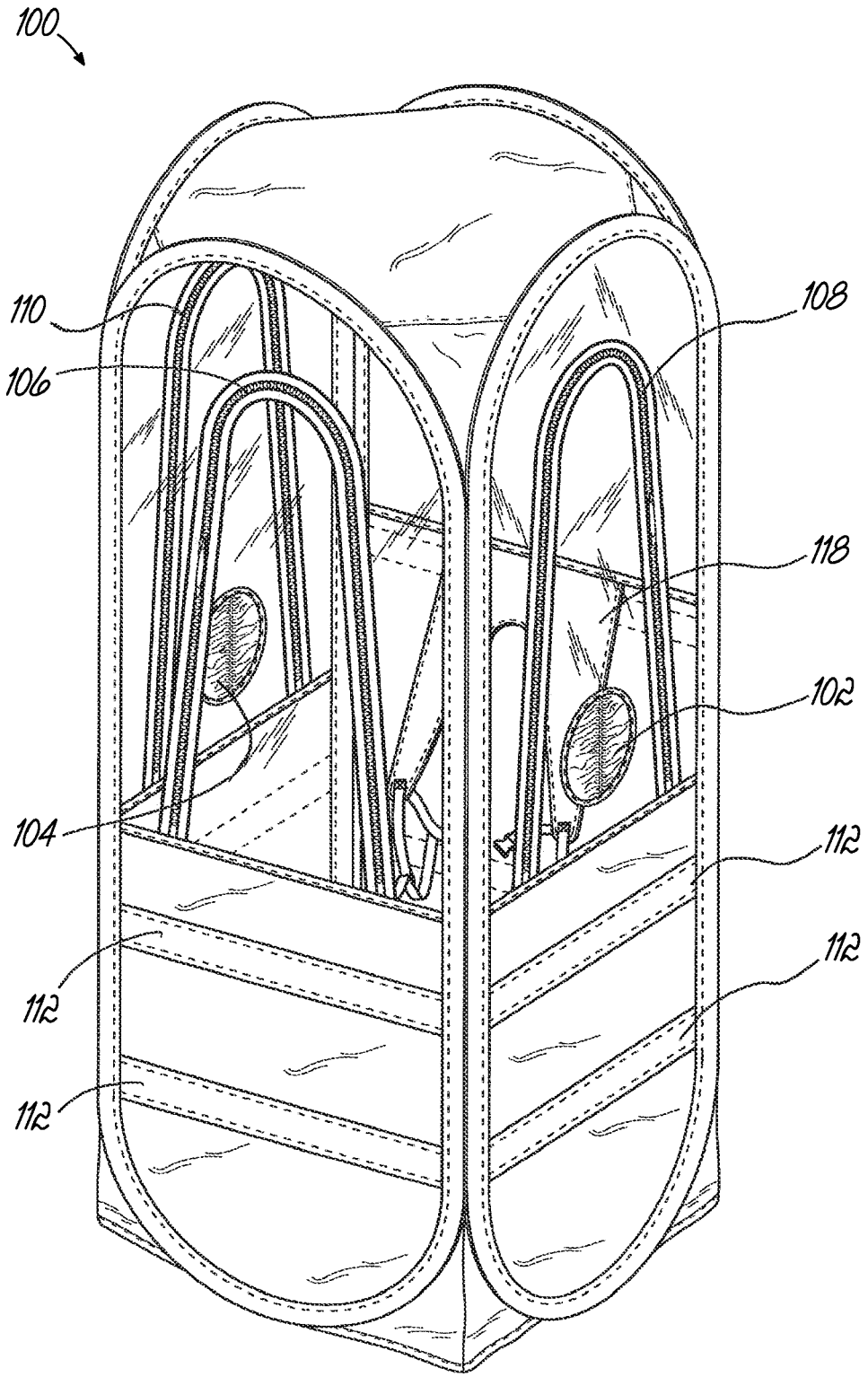
FIG. 1 schematically illustrates a perspective view of a personal pop-up pod.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of apparatus, arrangements, and methods for using a personal pop-up pods are hereinafter disclosed and described in detail with reference made to FIGS. 1-38.

Disclosed herein are novel personal pop-up pods designed for a single user, which can provide the user with protection from the surrounding elements while allowing the user to remain mobile, i.e., allow the user to move from location to location by walking, jogging or any other common mobile methods, and allowing the user to complete numerous manual tasks. In addition, the pop-up pod can include safety features, that will be subsequently described, to offer protection to the user. In summary, the personal pop-up pods disclosed herein are designed for various purposes. For example, the personal pop-up pod can be used by a worker that is required to work outside in the elements such as a crossing guard, a security guard, a laborer, a fast-food worker delivery meals purchased at a drive through window, medical professionals, patients, and many other circumstances. The personal pop-up pod can also be used for practical, medical, or recreation purposes to protect a user against inclement weather and disease. For example, a user that enjoys walking or jogging can use a personal pop-up pod in inclement weather to enjoy this recreational pastime. In the spring, an avid gardener may be able to more consistently enjoy that activity with the use of a personal pop-up pod. A student that needs to await a bus to transport the student to school can use a personal pop-up pod while awaiting the bus. A patient or medical professional can use a personal pop-up pod to protect against disease in a medical care facility. It will be understood that these are mere examples of the myriad of uses for personal pop-up pods as disclosed herein.

As schematically illustrated in FIGS. 1-8, a personal pop-up pod 100 can be designed with four sides (e.g., a front side, a rear side, a left side, and a right side), a top and a bottom. The four sides, top, and bottom can be a combination of clear and opaque materials. Two of the sides, such as the left side and right side, can include arm holes 102 and 104 that provides the user of the personal pop-up pod 100 with the opportunity to extend his or her arms outside the personal pop-up pod 100 when the personal pop-up pod 100 is carried by a user. Multiple sides (such as the front side, left side, and right side) can include zippers 106, 108, and 110 that can be zipped and unzipped and allow a flap of material to be moved to either expose or seal the inside of the personal pop-up pod 100 from the surrounding environment. It will be understood that one or more of the zippers 106, 108, and 110 can be unzipped at the user's discretion to configure the personal pop-up pod 100 to suit the user's needs for access to the environment surrounding the user and the personal pop-up pod.

The personal pop-up pod 100 can include a series of safety features such as reflective tape 112 that will visually alert those around the user of the personal pop-up pod 100 of the presence of the user. It will be understood that if the personal pop-up pod 100 is used for a potentially dangerous task such as a police officer directing traffic, a parking lot attendant surveying a parking lot, or a jogger jogging along a roadway, the reflective tape 112 will reflect the headlights of oncoming vehicles and greatly increase the chances of drivers seeing the user and thus, greatly decreasing the chances of an accident involving the user. The material used for the side, top and bottom panels can be constructed of brightly colored material to add additional safety to the use of the personal pop-up pod.

Figure 2:
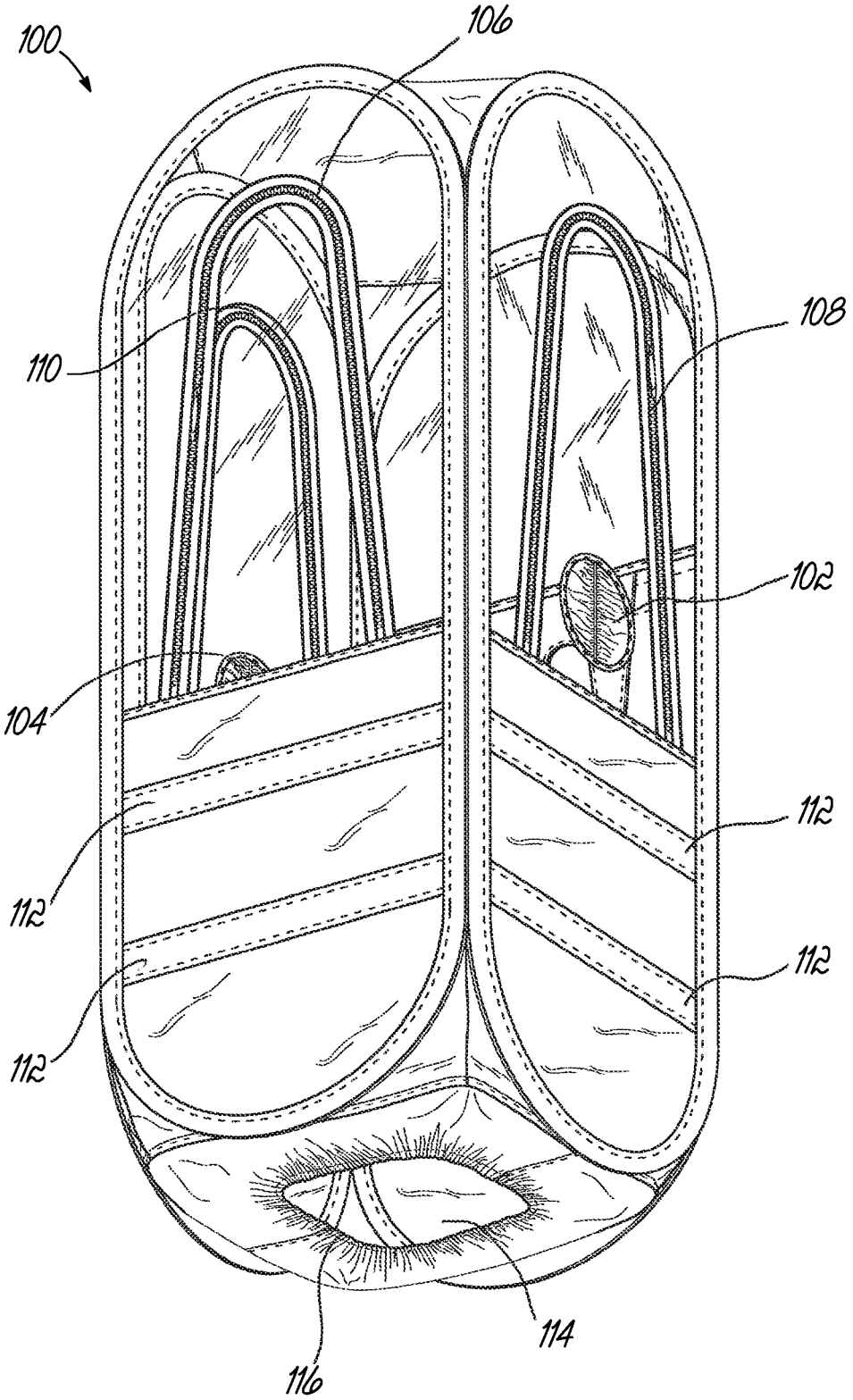
FIG. 2 schematically illustrates another perspective view of the personal pop-up pod of FIG. 1.
Figure 8:
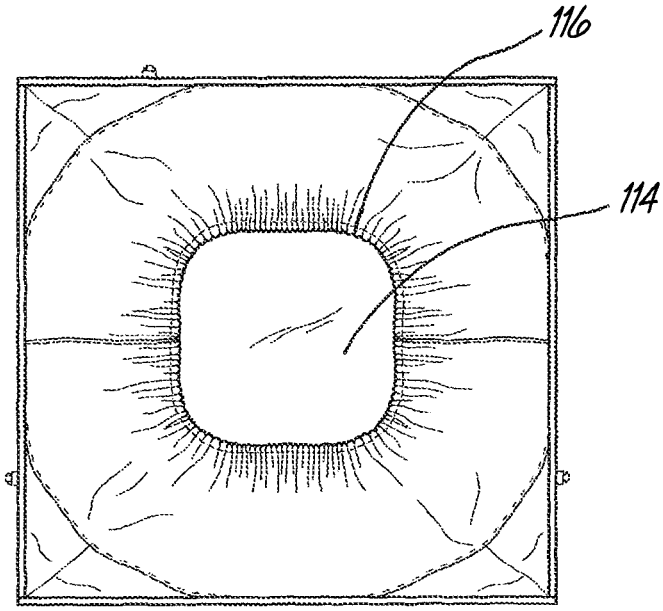
FIG. 8 schematically illustrates a bottom view of the personal pop-up pod of FIG. 1.
Figure 9:
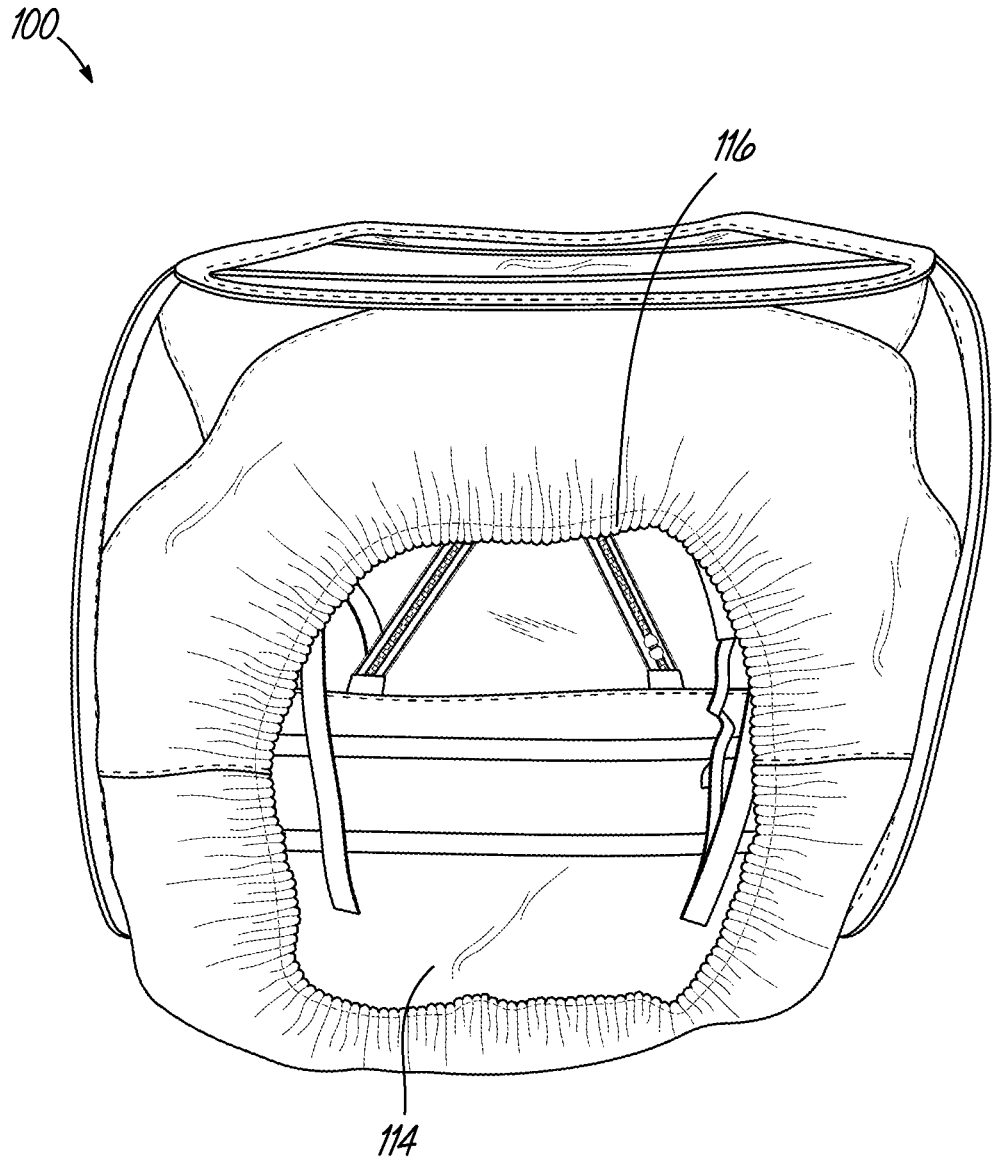
FIG. 9 schematically illustrates a bottom view of the personal pop-up pod.

As best illustrated in FIGS. 2, 8, and 9, the bottom of the personal pop-up pod 100 includes an opening 114. The opening 114 can include an elastic band 116 about the perimeter of the opening 114. The opening 114 allows a user to slide the personal pop-up pod 100 over the user's head and downward until the user is situated in the personal pop-up pod 100. The elastic band 116 can fit snuggly about the user's legs to further protect portions of the user's body from the elements. It will be understood that the user can remove the personal pop-up pod in a similar fashion by moving the personal pop-up pod upwardly over the user's head until the personal pop-up pod is removed from the user.

Figure 3:
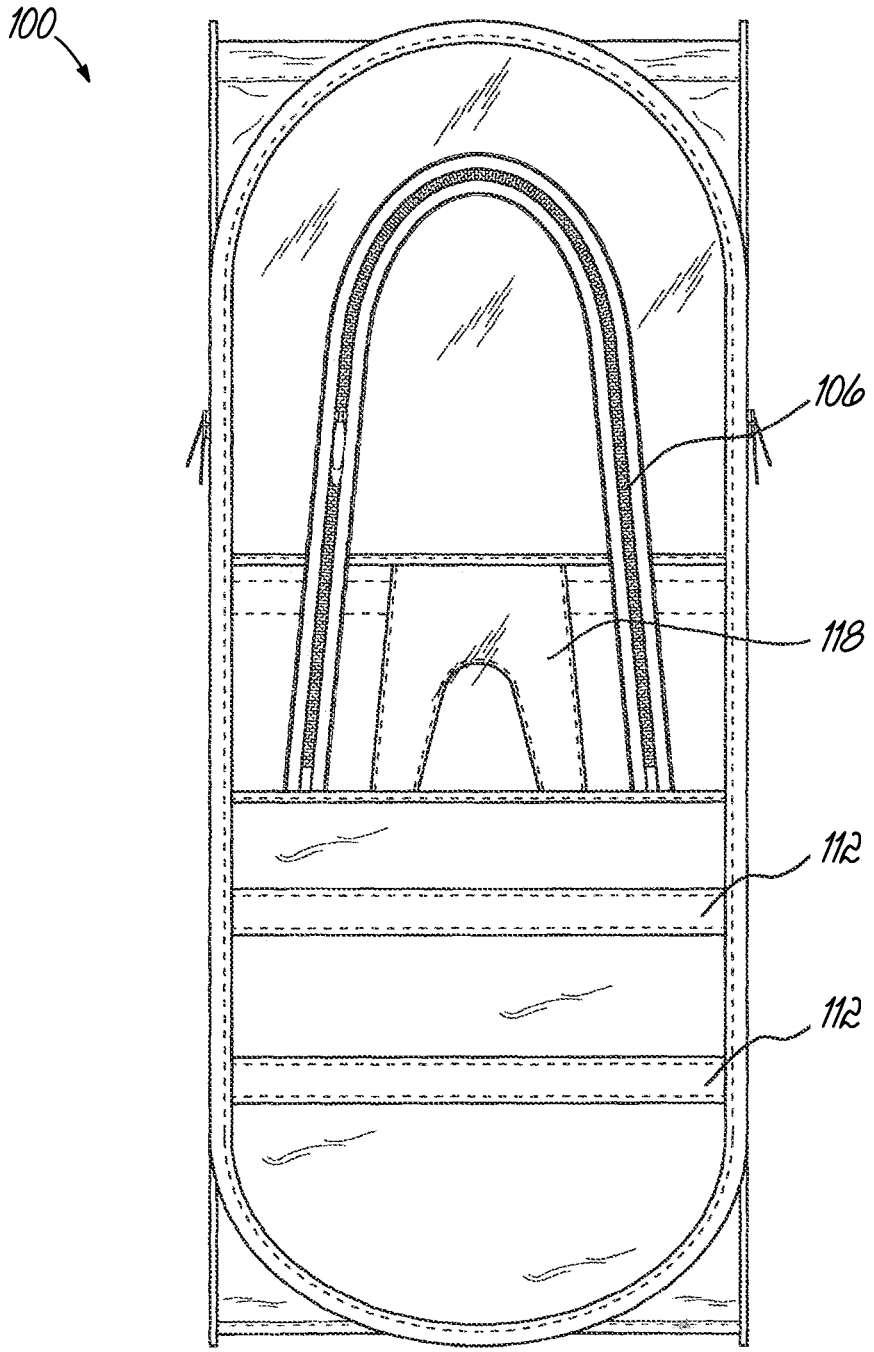
FIG. 3 schematically illustrates a front view of the personal pop-up pod of FIG. 1.
Figure 4:
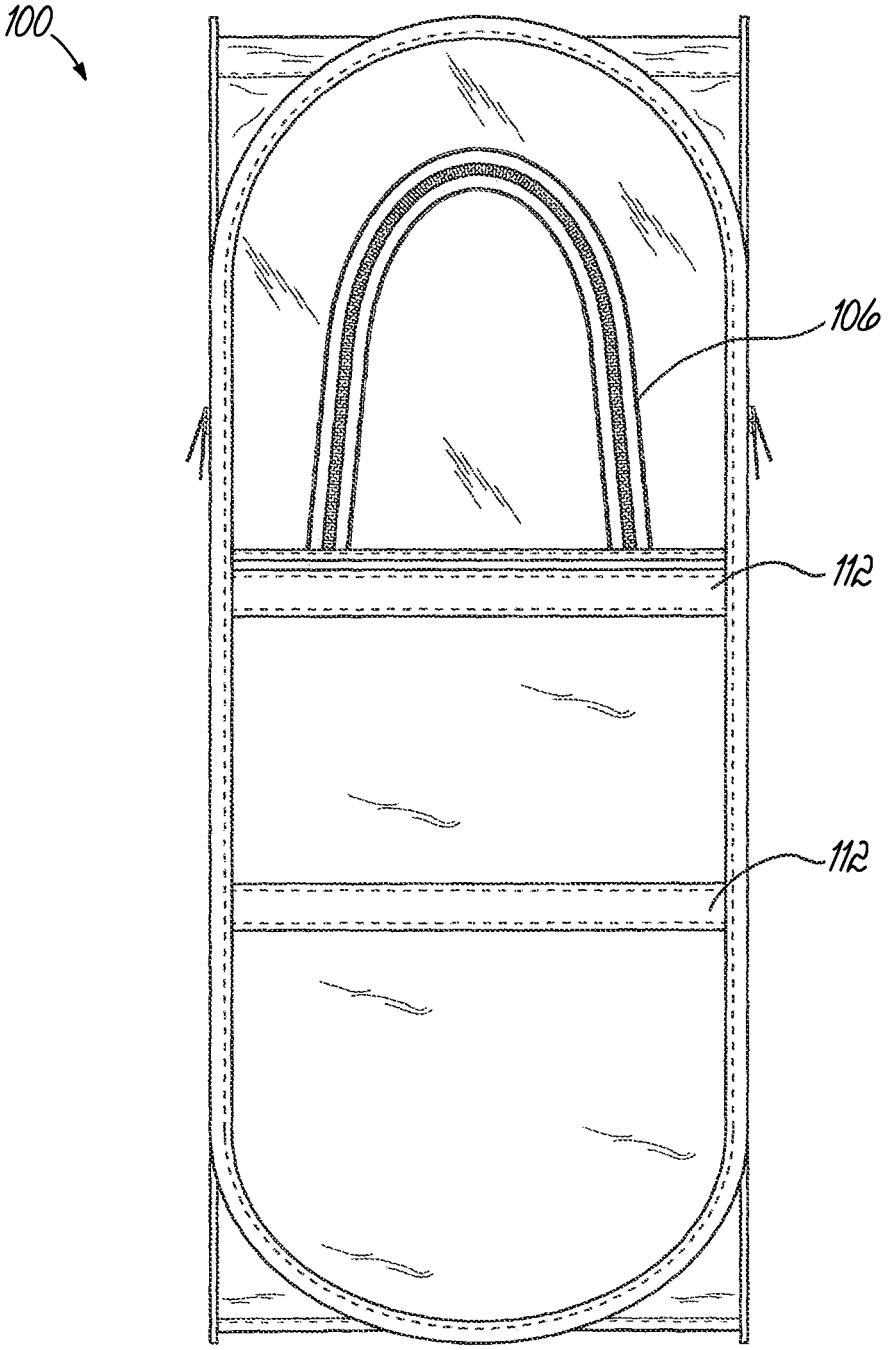
FIG. 4 schematically illustrates a rear view of the personal pop-up pod of FIG. 1.
Figure 5:
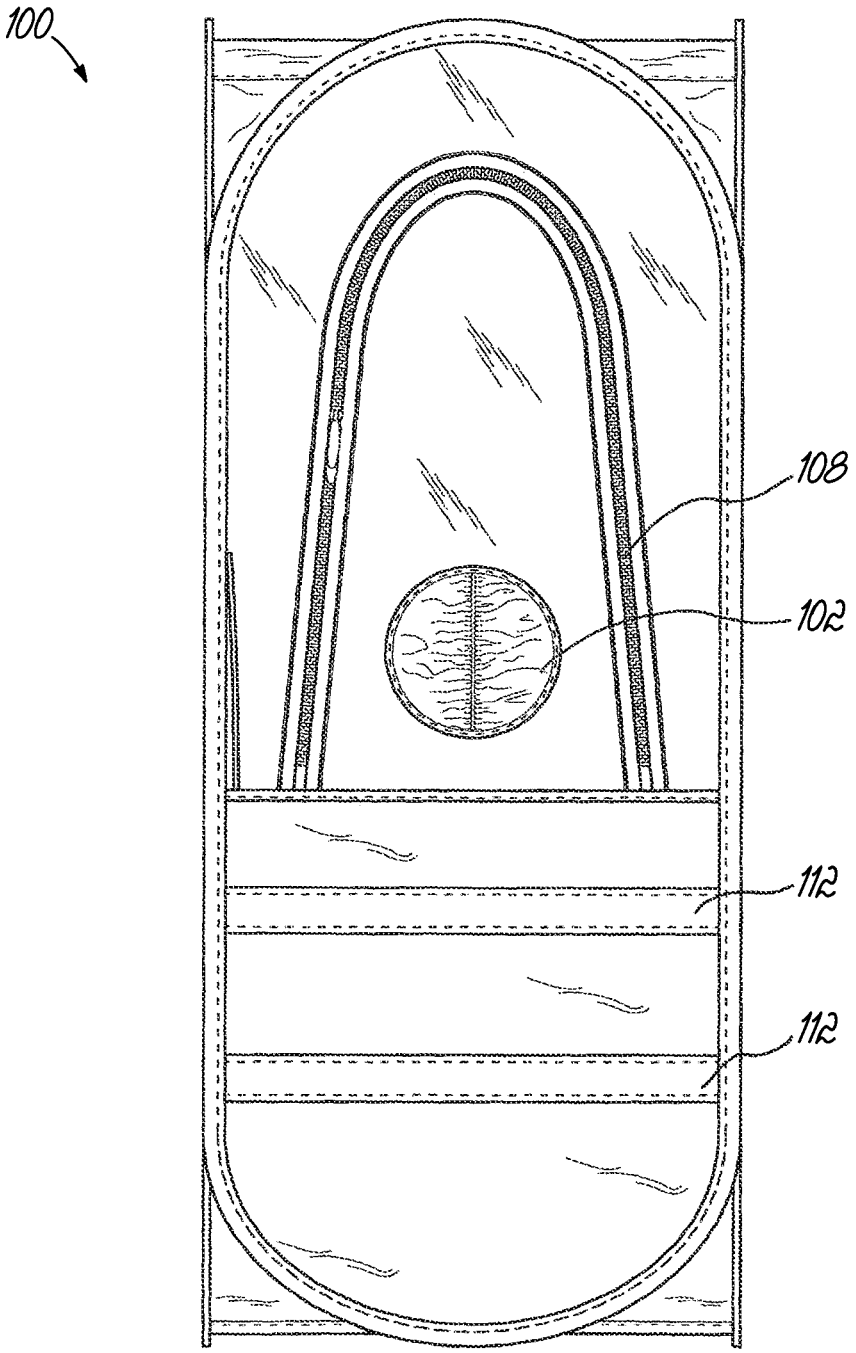
FIG. 5 schematically illustrates a left side view of the personal pop-up pod of FIG. 1.
Figure 6:
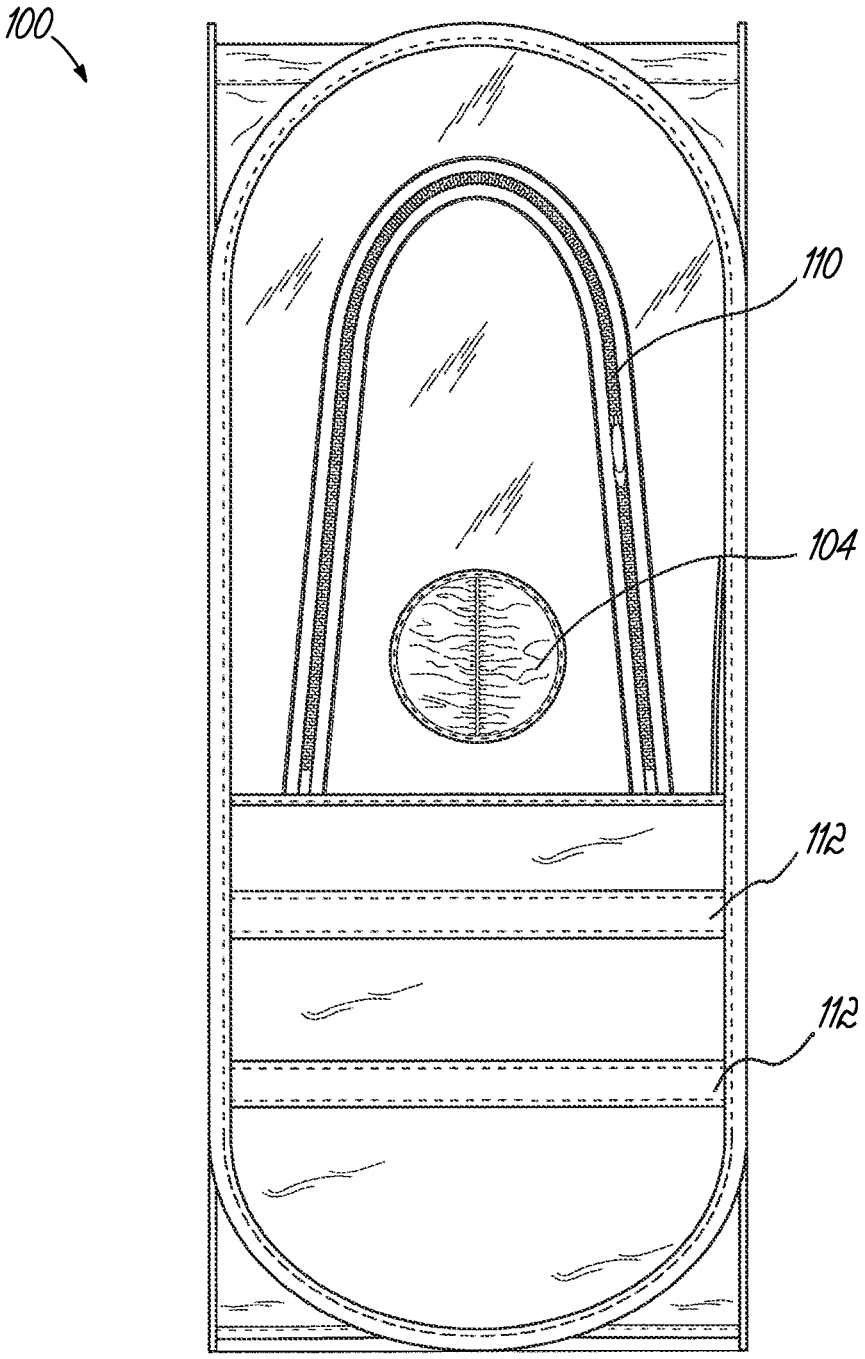
FIG. 6 schematically illustrates a right side view of the personal pop-up pod of FIG. 1.
Figure 7:
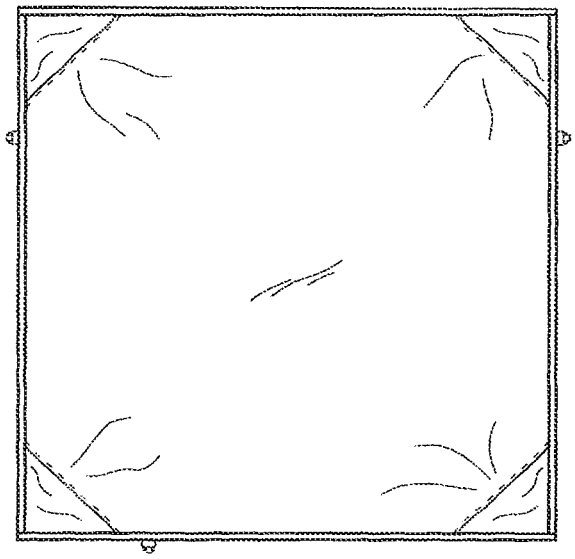
FIG. 7 schematically illustrates a top view of the personal pop-up pod of FIG. 1.

As best illustrated in FIG. 3, the personal pop-up pod 100 includes a harness 118. The harness 118 is secured to the inside surface of the rear side of the personal pop-up pod 100. When a user slides the personal pop-up pod 100 over the user's head and downward, the user can place an arm through each side of the harness 118 and position the harness 118 on the user's shoulder in a manner such that the personal pop-up pod 100 is fully supported by the engagement of the harness 118 and the user's shoulders. The harness 118 can include pull tabs that can be pulled to take up any slack in the harness 118 and snuggly secure the harness 118 to the user's shoulders.

Once the harness 118 is snuggly secured to the user's shoulders, it will be understood that the personal pop-up pod 100 will generally move with the user, including moving in the same direction and distance as the user's forward and backward motion, side to side motion, twisting or rotating motion, and up and down motion. When the user is engaged with the harness 118 and the personal pop-up pod 100 is "carried" by the user, it will be understood that the rear side of the personal pop-up pod 100 will generally be in contact with or very close to the user's back and there will be gaps or spaces between the user's body and the front side, left side, and right side of the personal pop-up pod 100.

While the attachment mechanism of the personal pop-up pod is illustrated and described as a harness, it will be understood that other attachment mechanisms can be used. For example, two independent straps can be used in place of a harness.

Figure 10:
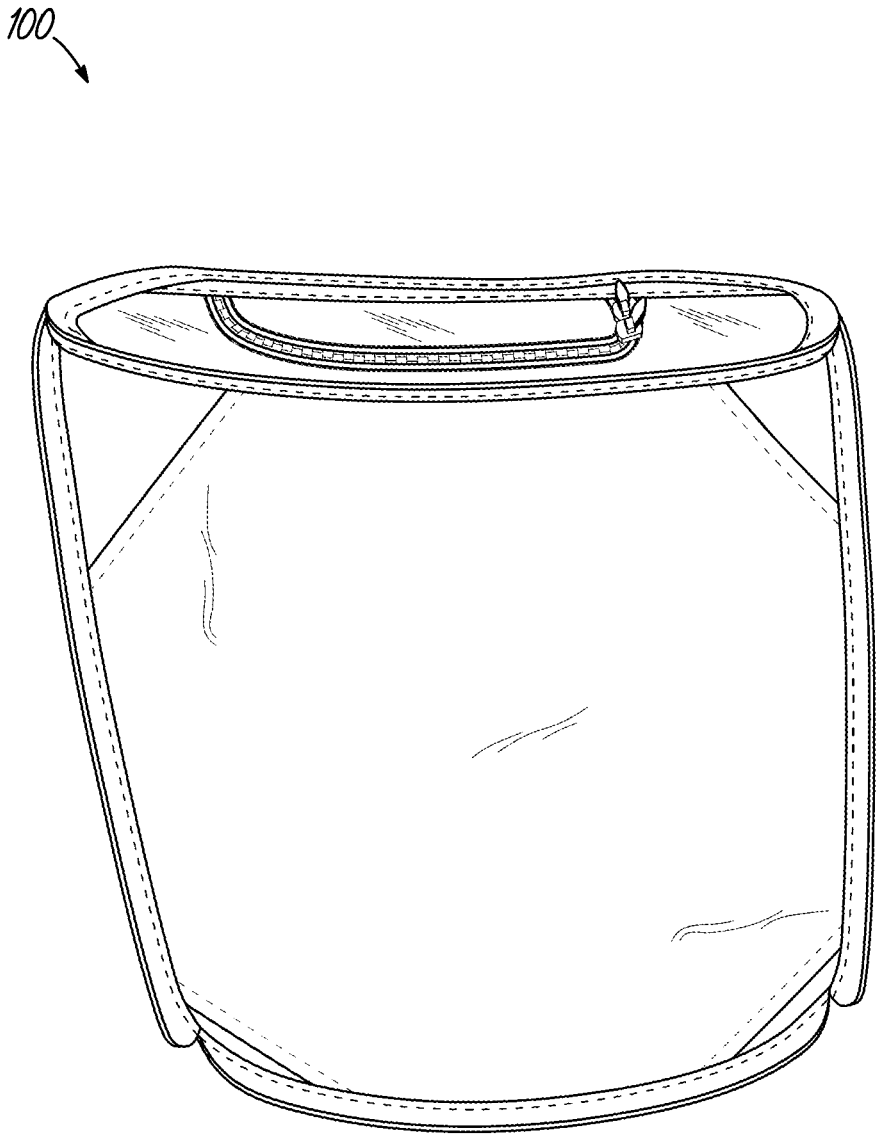
FIG. 10 schematically illustrates a top view of the personal pop-up pod.
Figure 11:
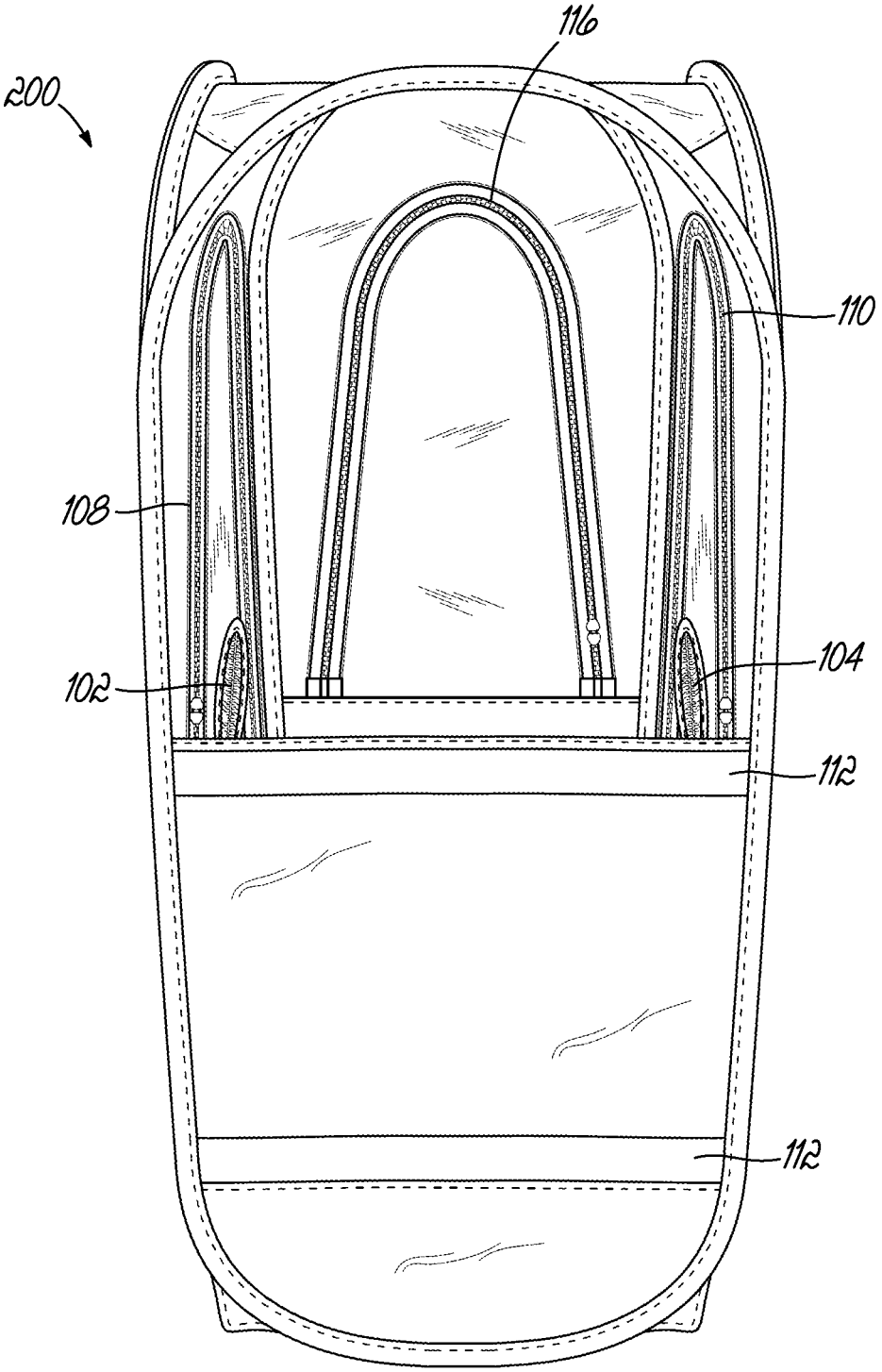
FIG. 11 schematically illustrates a rear view of the personal pop-up pod.
Figure 12:
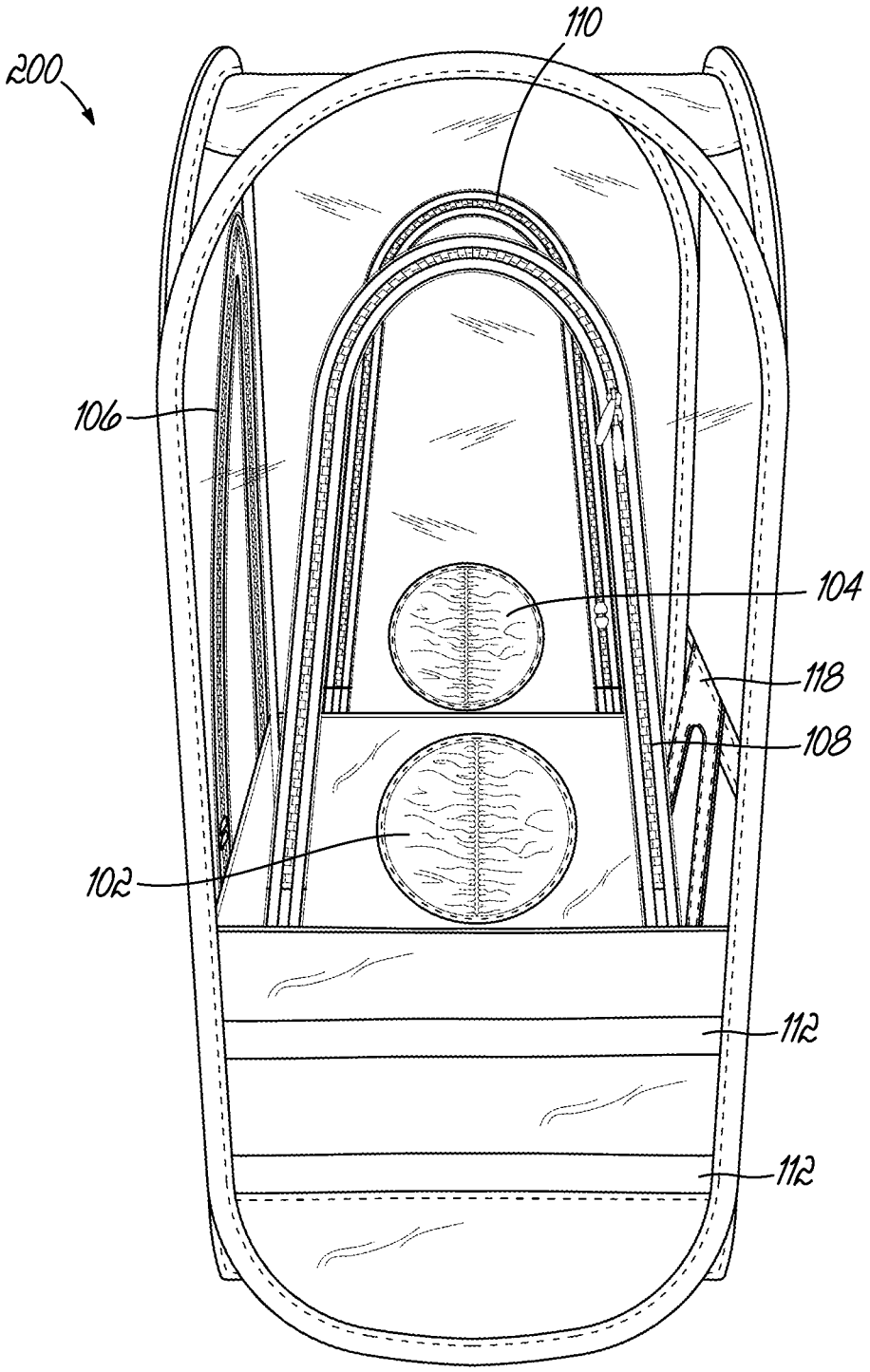
FIG. 12 schematically illustrates a side view of the personal pop-up pod.
Figure 13:
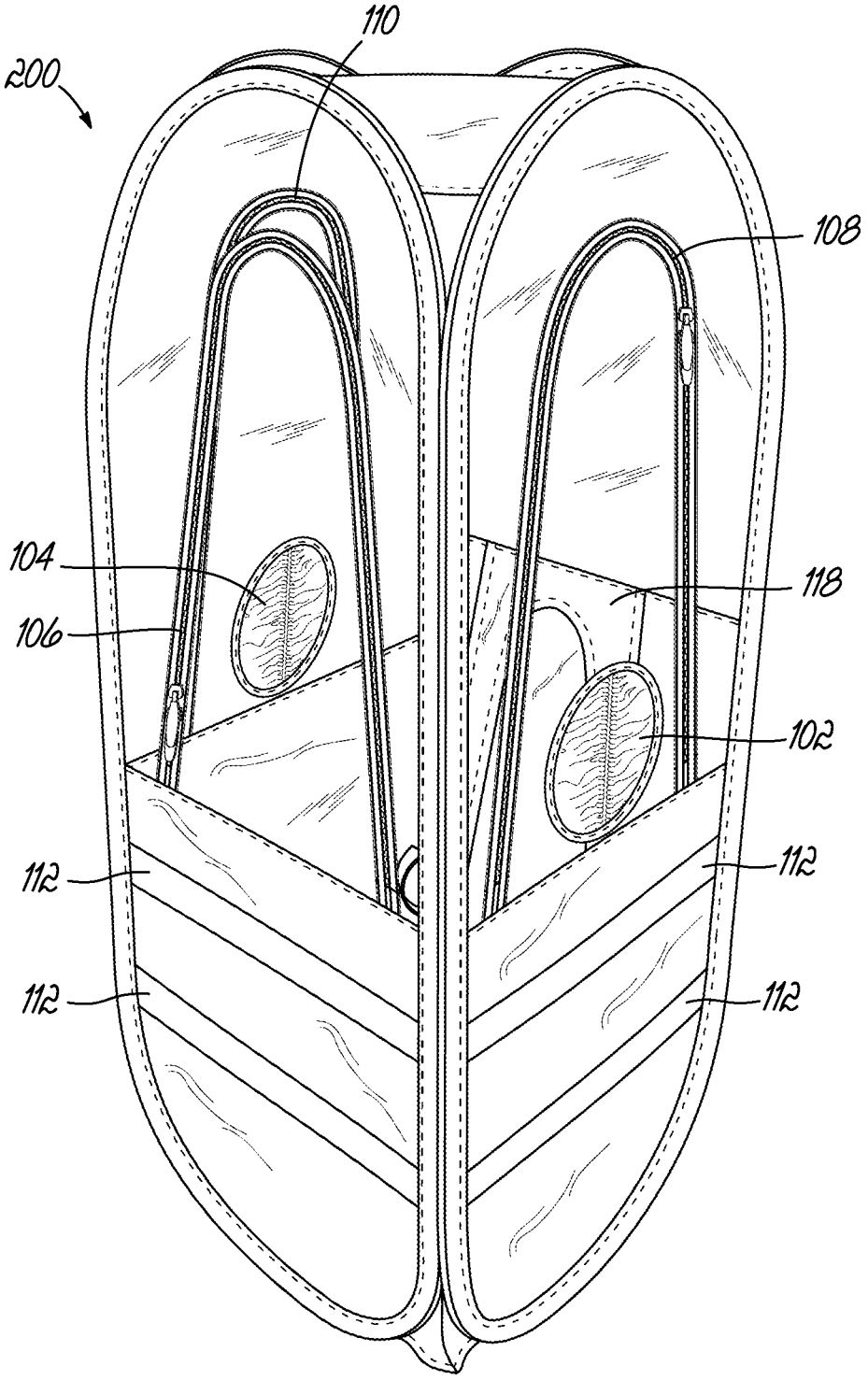
FIG. 13 schematically illustrates a perspective view of the personal pop-up pod.
Figure 14:
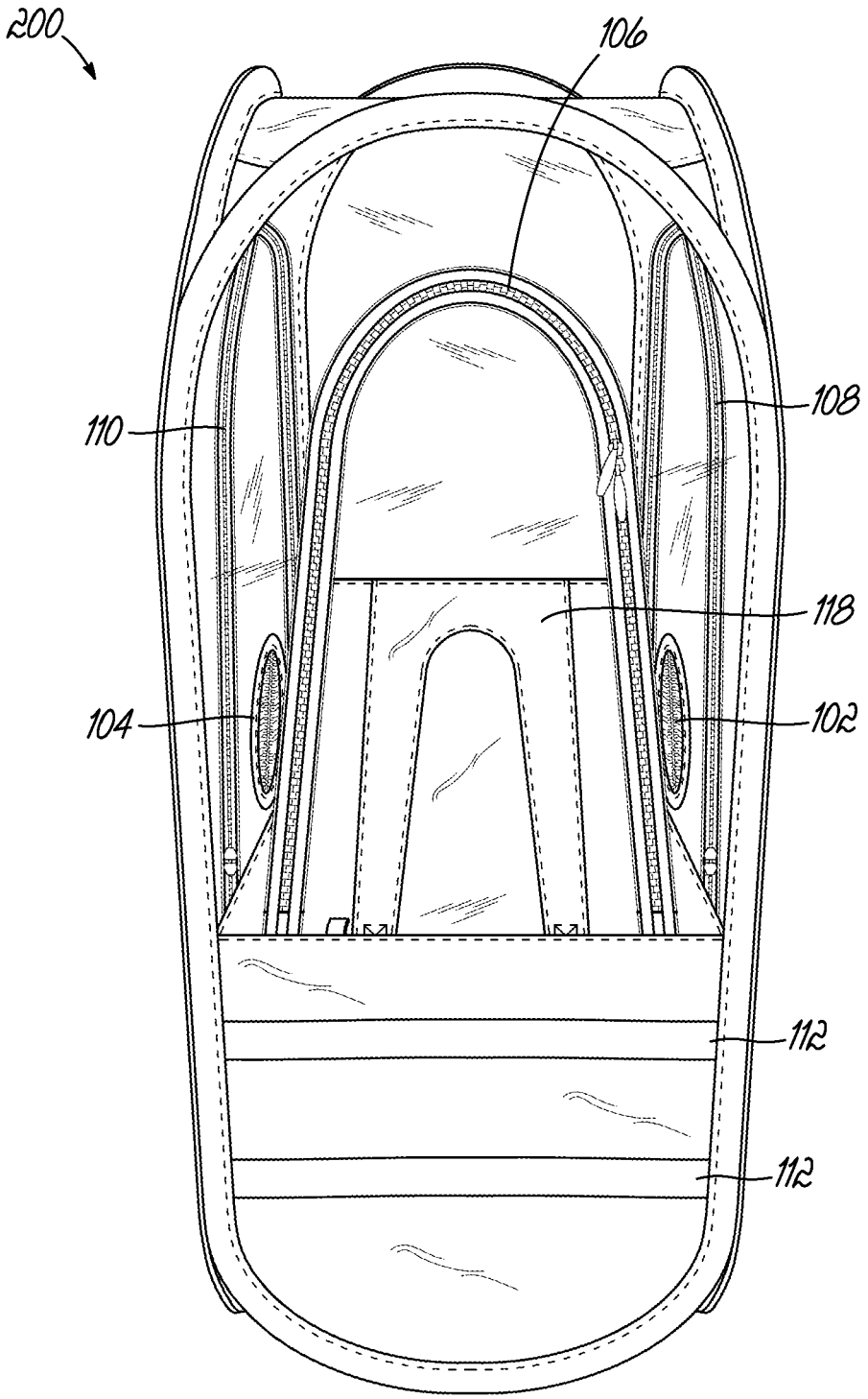
FIG. 14 schematically illustrates a front view of the personal pop-up pod.

FIG. 10 schematically illustrates a personal pop-up pod with an opaque top, where the material can be a bright yellow (i.e., safety yellow), which provides additional safety for the user of the pod. Similar to the reflective tape 112, such a color can better alert those proximate to the user of the user's presence. In addition to safety yellow, other colors such as orange and red can be used as safety colors.

Figure 15:
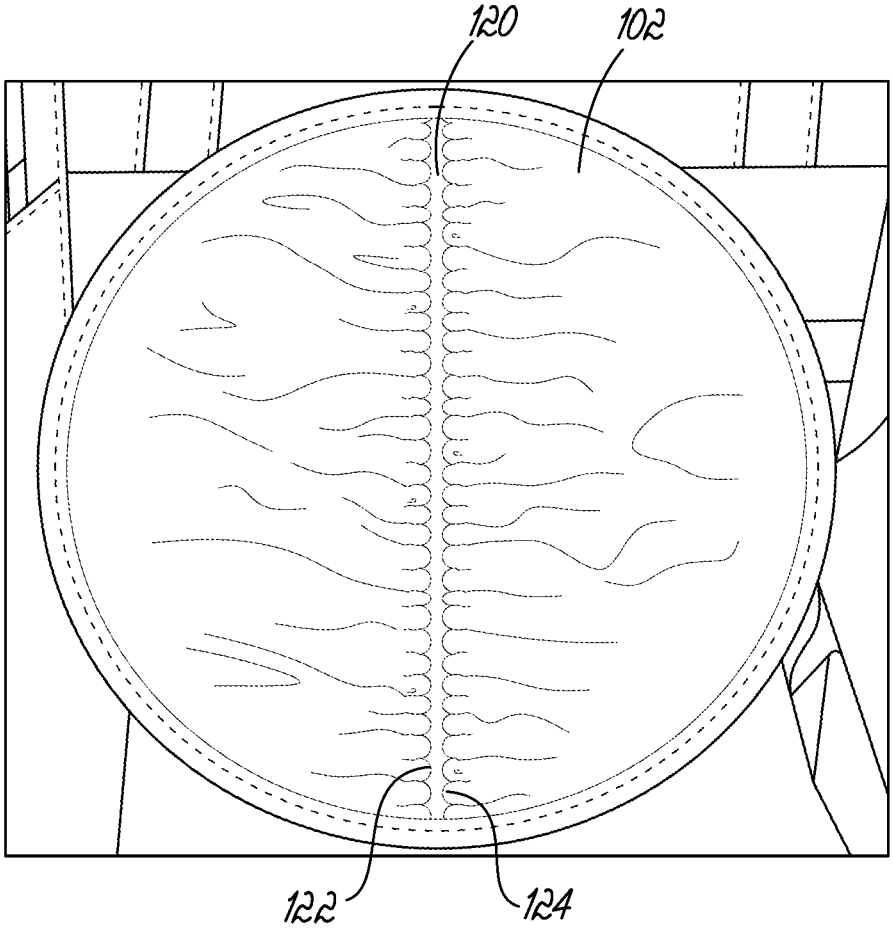
FIG. 15 schematically illustrates an arm hole of the personal pop-up pod.

FIGS. 11-14 schematically illustrate a personal pop-up pod 200 with different dimensions that the personal pop-up pod 100 of FIGS. 1-10. The personal pop-up pod includes the same features—two arm holes 102, 104, zippers 106, 108, 110 to unzip window segments, reflective striping 112, an opening 114 that includes an elastic band 116, and a harness. The top half of the personal pop-up pods 100, 200 have clear panels so that the user can have a 360 degree view of his or her surroundings. The bottom half of the personal pop-up pod includes opaque panels, again in a safety yellow, and a reflective tape. As illustrated in FIG. 15, the arm holes 102, 104 in the left and right sides of the personal pop-up pods can include a slits 120 that allow for the user to place his or her arms through the slits 120 to access the surrounding environment with his or her arms. The slit 120 of the armhole can be formed by two edges 122, 124 that have elastic bands running along the edges 122, 124. As will be understood, when a user passes his or her arm through the slit 120, the elastic bands at the edges 122, 124 will snuggly conform to the user's arm so that the elements, including rain, snow, and wind or contagious diseases will be blocked from entering the personal pop-up pod through the arm holes 102, 104.

Figure 16:
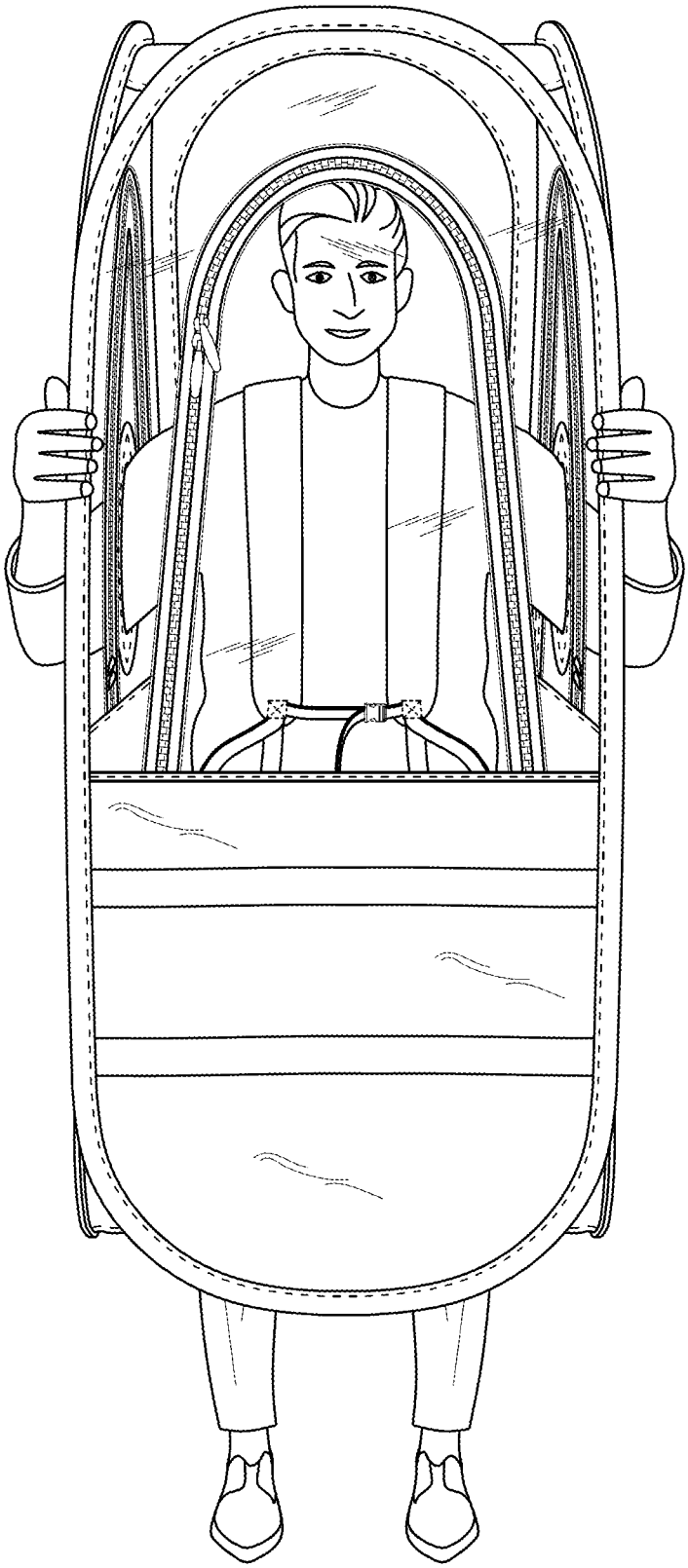
FIG. 16 schematically illustrates a front view of the personal pop-up pod as carried by a user.
Figure 17:
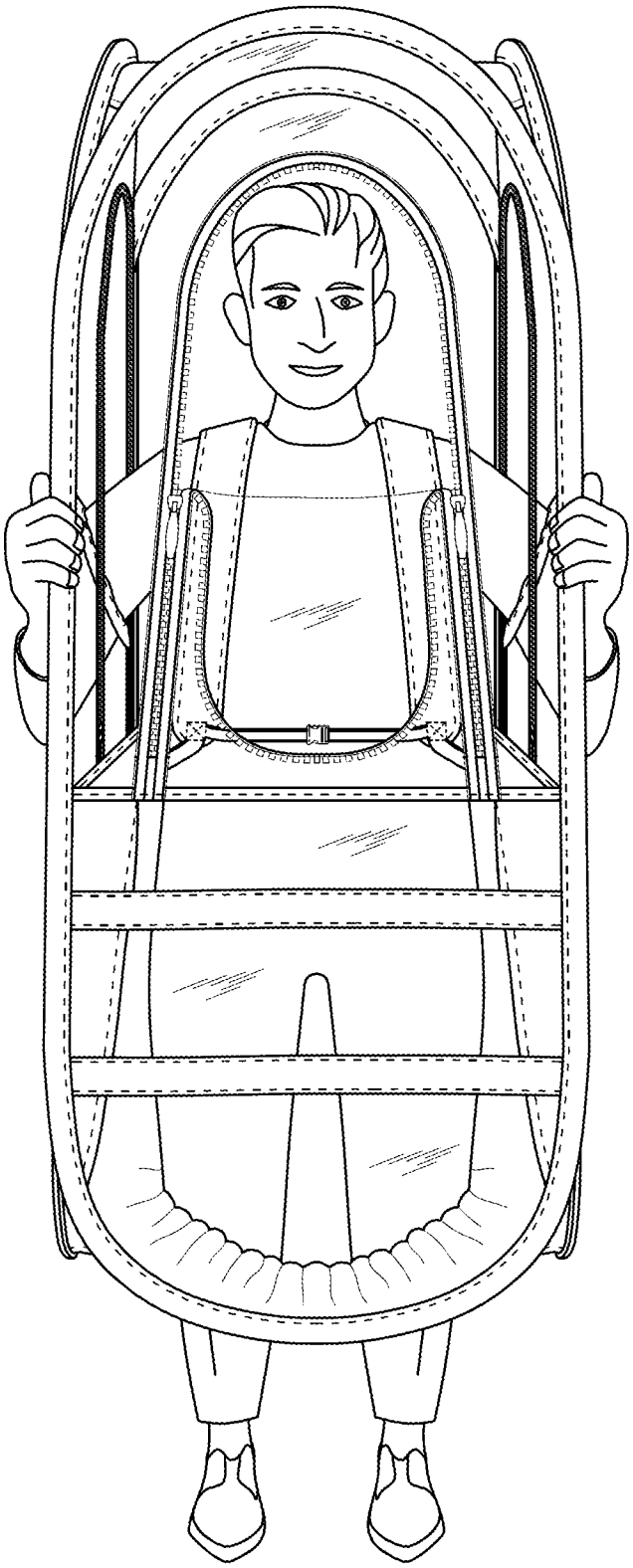
FIG. 17 schematically illustrates a front view of another personal pop-up pod as carried by a user.
Figure 18:
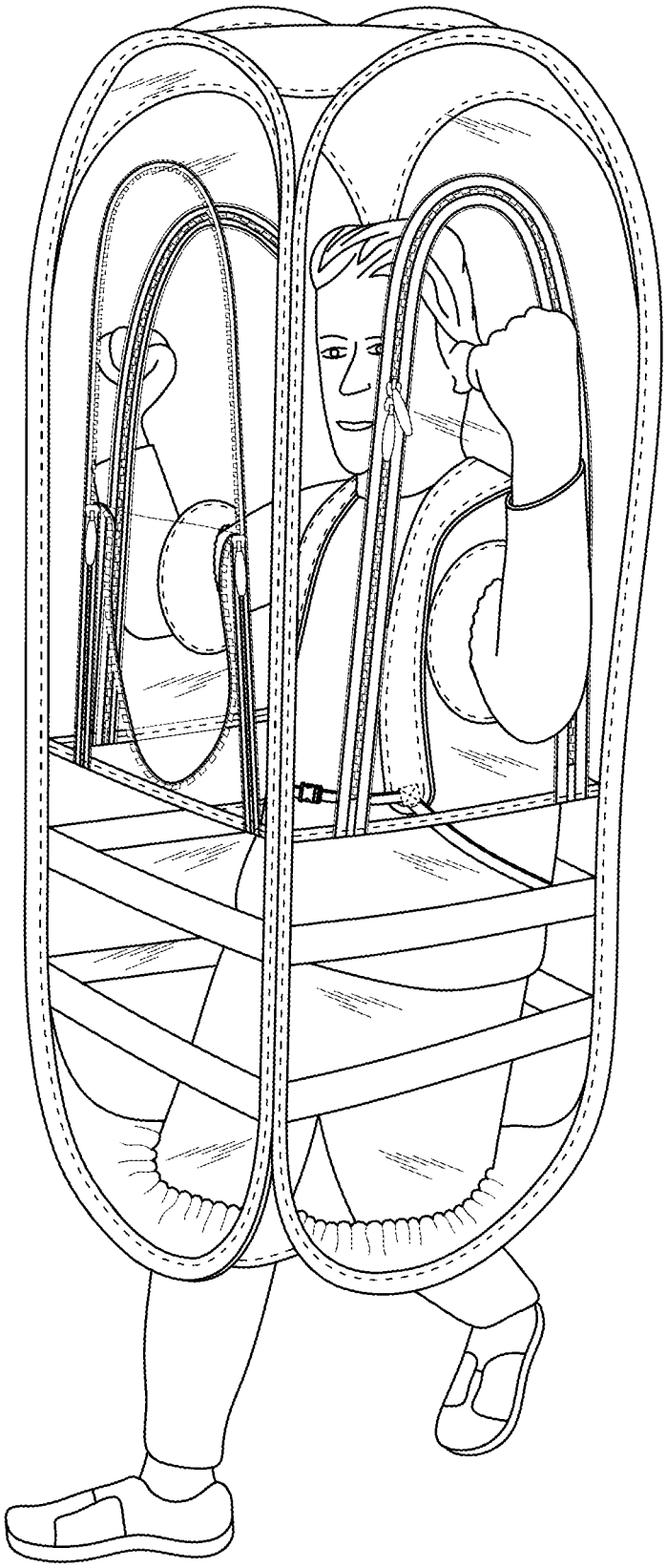
FIG. 18 schematically illustrates a perspective view of the personal pop-up pod as carried by a user.
Figure 19:
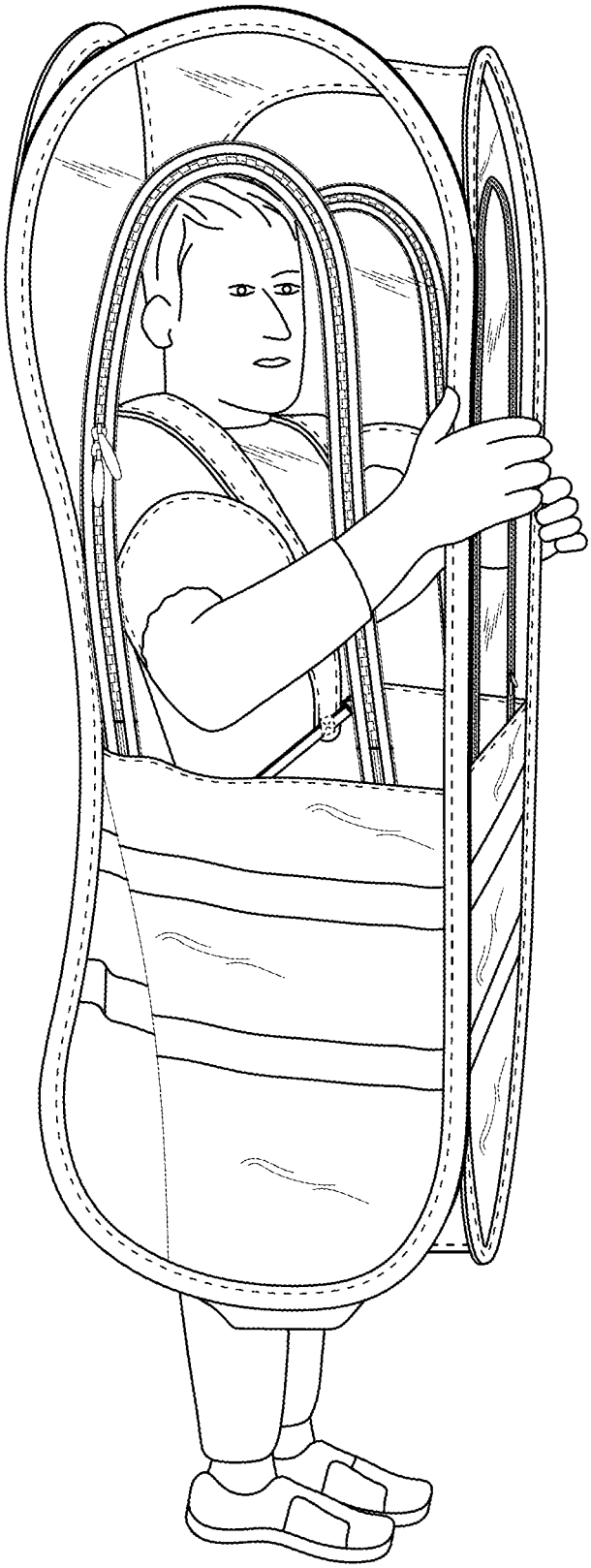
FIG. 19 schematically illustrates a side view of the personal pop-up pod as carried by a user.
Figure 20:
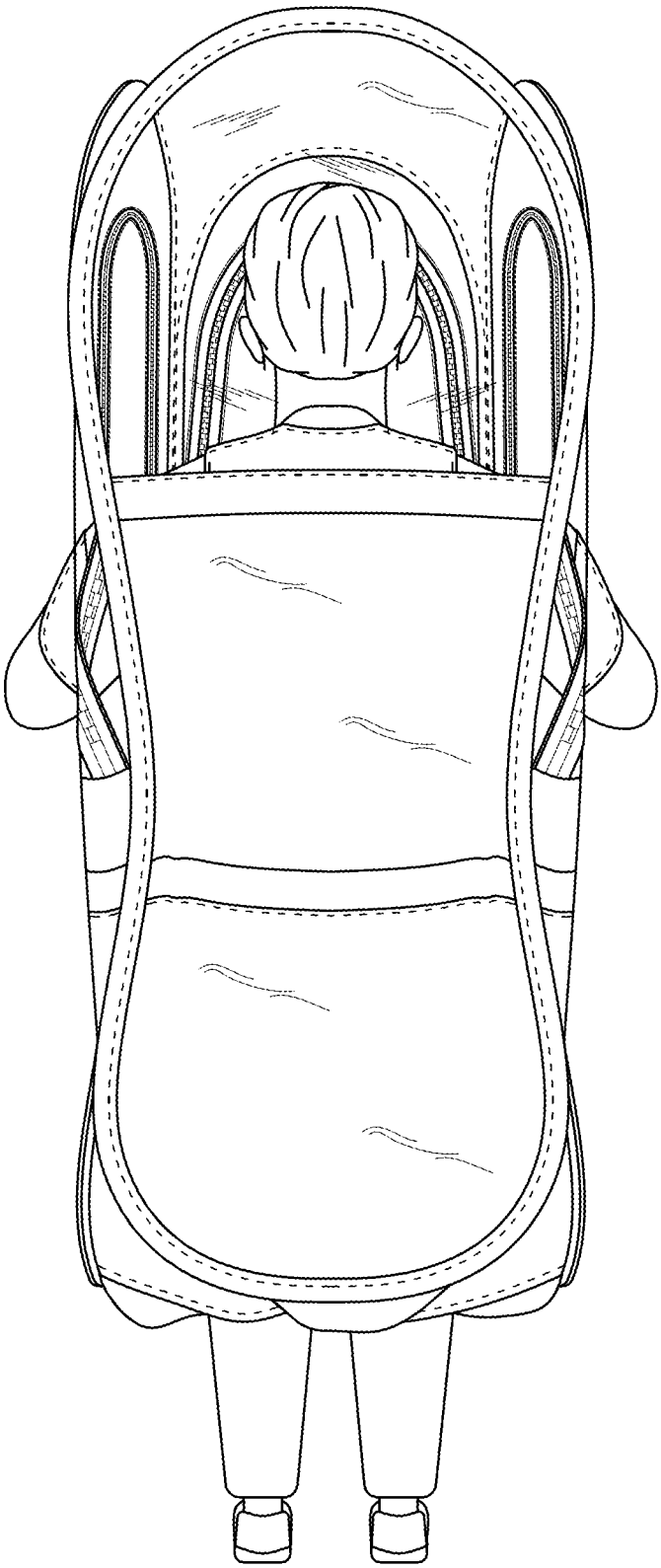
FIG. 20 schematically illustrates a rear view of the personal pop-up pod as carried by a user.
Figure 21:
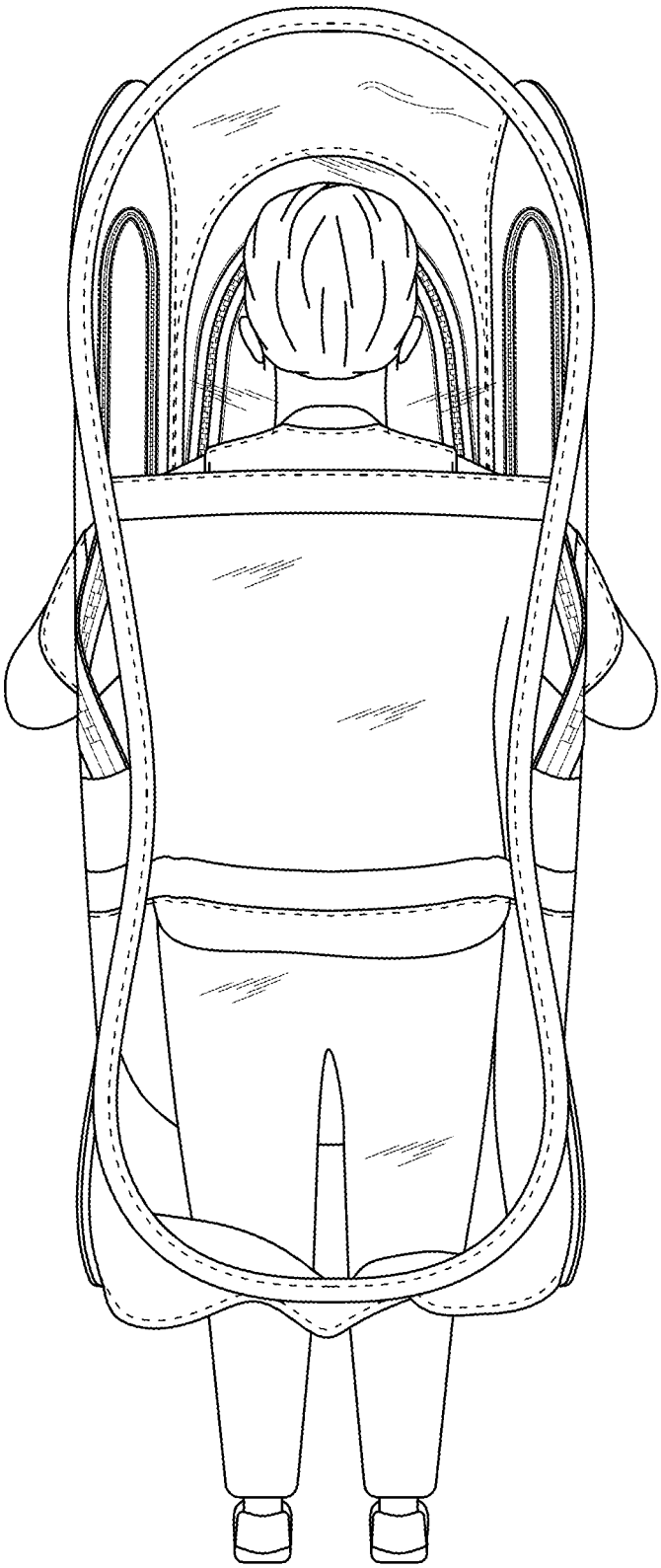
FIG. 21 schematically illustrates a rear view of another personal pop-up pod as carried by a user.

FIGS. 16-21 schematically illustrate a user carrying a personal pop-up pod. FIG. 16 illustrates a front perspective view showing a user carrying a personal pop-up pod with clear panels on the top half of the personal pop-up pod and opaque panels with reflective tape on the bottom half of the personal pop-up pod. The harness can be seen across the user's shoulders, and the user has his arms extending through arm holds on either side of the personal pop-up pod. The personal pop-up pod illustrated in FIG. 16 has a height of about 54 inches and a width is about 22 inches. FIG. 17 is similar to FIG. 16, but the personal pop-up pod includes full clear panels. The full clear panels provides better visibility for the user and provides a more complete view of the user for those around the user. The reflective tape and safety yellow trim at the intersections of the side panels provides safety features for the user. FIG. 18 is a perspective view of the user carrying the personal pop-up pod shown in FIG. 17. In this view, the user is demonstrating the range of motion of his arms as they extend though the arm holes. It will be understood that the range of motion provided by the arm holes and the personal pop-up pod in general, allows the user to accomplish any number of physical and manual tasks. For example, if the user is tasked with directing traffic with a flag or other instrument, the personal pop-up pod provides the range of motion required for such a task. Additionally, as shown in FIG. 18, the zipper in the front side is unzipped to provide a passage through the front panel of the personal pop-up pod. Such a passage in the front panel can be useful if the user is employed by a fast food restaurant and tasked with delivering meals to customers parked in automobiles who ordered via a drive through window. In such a situation, the user can protect the meals from inclement weather by keeping the meal within the personal pop-up pod. When the user approaches the automobile, the user can unzip the zipper in the front panel and hand the meal to the waiting customer. FIGS. 19-21 show additional views of a user carrying a personal pop-up pod.

As will be understood, the side panels, top panel, and bottom panel are made of material that resists the penetration of water, wind, and contagious viruses so that the personal pop-up pod protects the user from inclement elements such as snow, rain, sleet, gusts, and infectious diseases. With regard to the harness, a top portion and bottom portion of the harness are attached at the rear panel of the personal pop-up pod. In such an arrangement, the user can slide his or her arms through each side of the harness (such is commonly done for a backpack) and tighten the straps to secure the personal pop-up pod to the user's shoulders and back. The user can then freely walk about with the personal pop-up pod secured to the user.

As previously noted, the personal pop-up pod can be used by workers that have to work in the elements. In one example, a crossing guard can use a personal pop-up pod to perform his or her duties in assisting children and other persons crossing busy streets. The zippers in the side panels can be unzipped to create windows, where the windows can allow the user of the personal pop-up pod to use a hand held stop sign that is common for crossing guards. In another example, a worker at a fast food restaurant can use a personal pop-up pod to move from vehicle to vehicle and take and deliver orders for customers in inclement weather. Again, the zippers can be used to open and close windows in the front and side panels to provide the user with the flexibility to hand out orders and take payment, while still remaining protected by from the elements.

Further disclosed herein are novel personal pop-up pods designed for a single user, which can provide the user with protection from the surrounding elements and provide the user with privacy. In summary, the personal pop-up pods disclosed herein are designed for various purposes. For example, a personal pop-up pod can be designed to accommodate a user that is seated in a generally crowded environment with other persons seated next to the user, such as for example in a sports stadium (i.e., a "stadium pod"). In such an example, a stadium pod can protect the user from the surrounding elements, such as rain, snow, wind, and cold, while allowing the user to view the event. In another example, a personal pop-up pod can be designed to accommodate a user that is seated in a generally crowded environment with other persons seated next to the user, such as for example an airplane, train, bus, subway, and the like (i.e., a "travel pod"). In such an example, a travel pod can provide the user with privacy in an otherwise crowded area. In another example, a personal pop-up pod can be designed to accommodate a user that needs to move from one location to another, such as a worker that needs to work outside in the elements (i.e., a "mobile pod").

Figure 22:
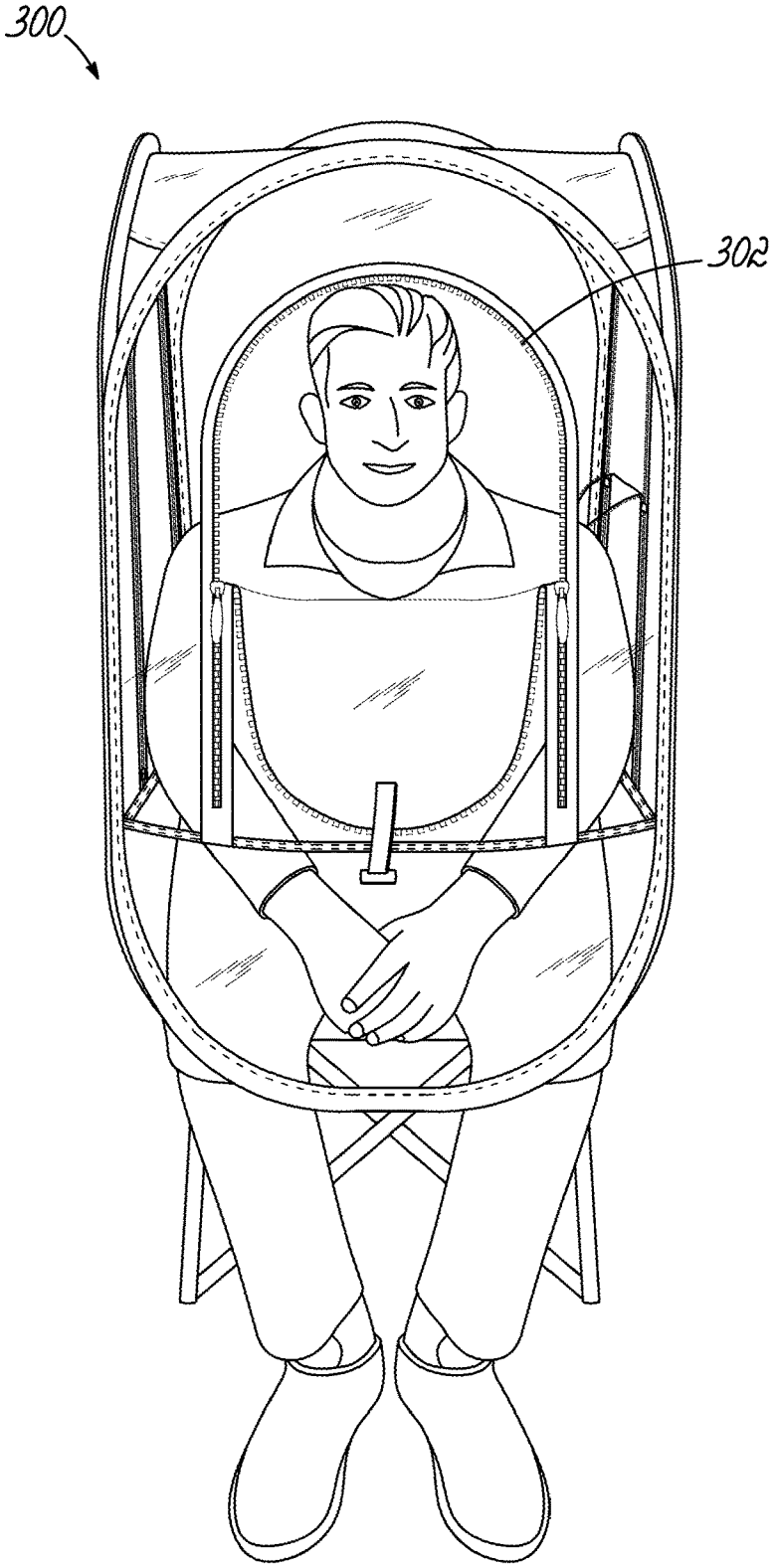
FIG. 22 schematically illustrates an exemplary front perspective view of a personal pop-up pod that accommodates one user.
Figure 23:
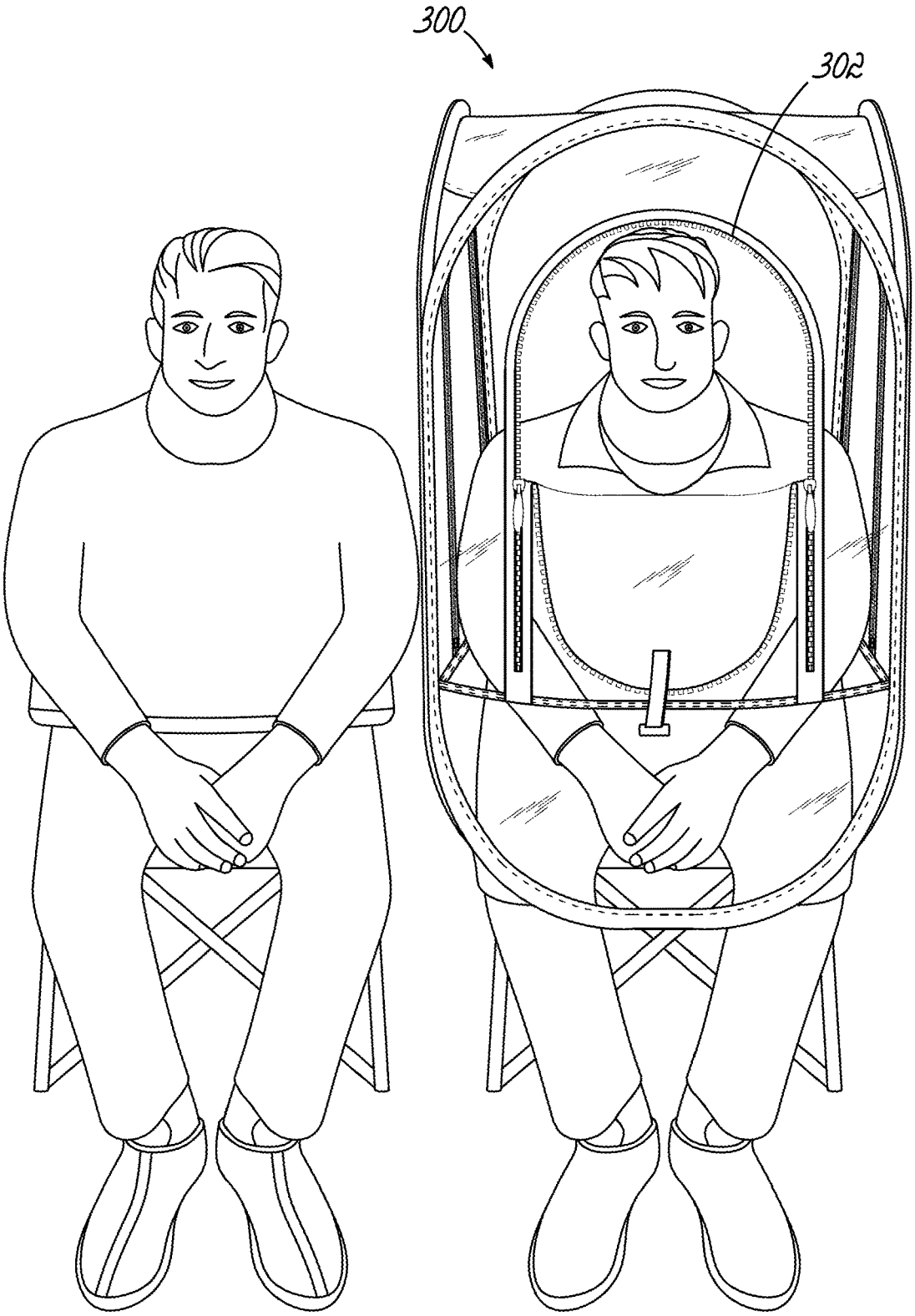
FIG. 23 schematically illustrates an exemplary front perspective view of a personal pop-up pod of FIG. 22, where the user is seated next to another person.
Figure 24:
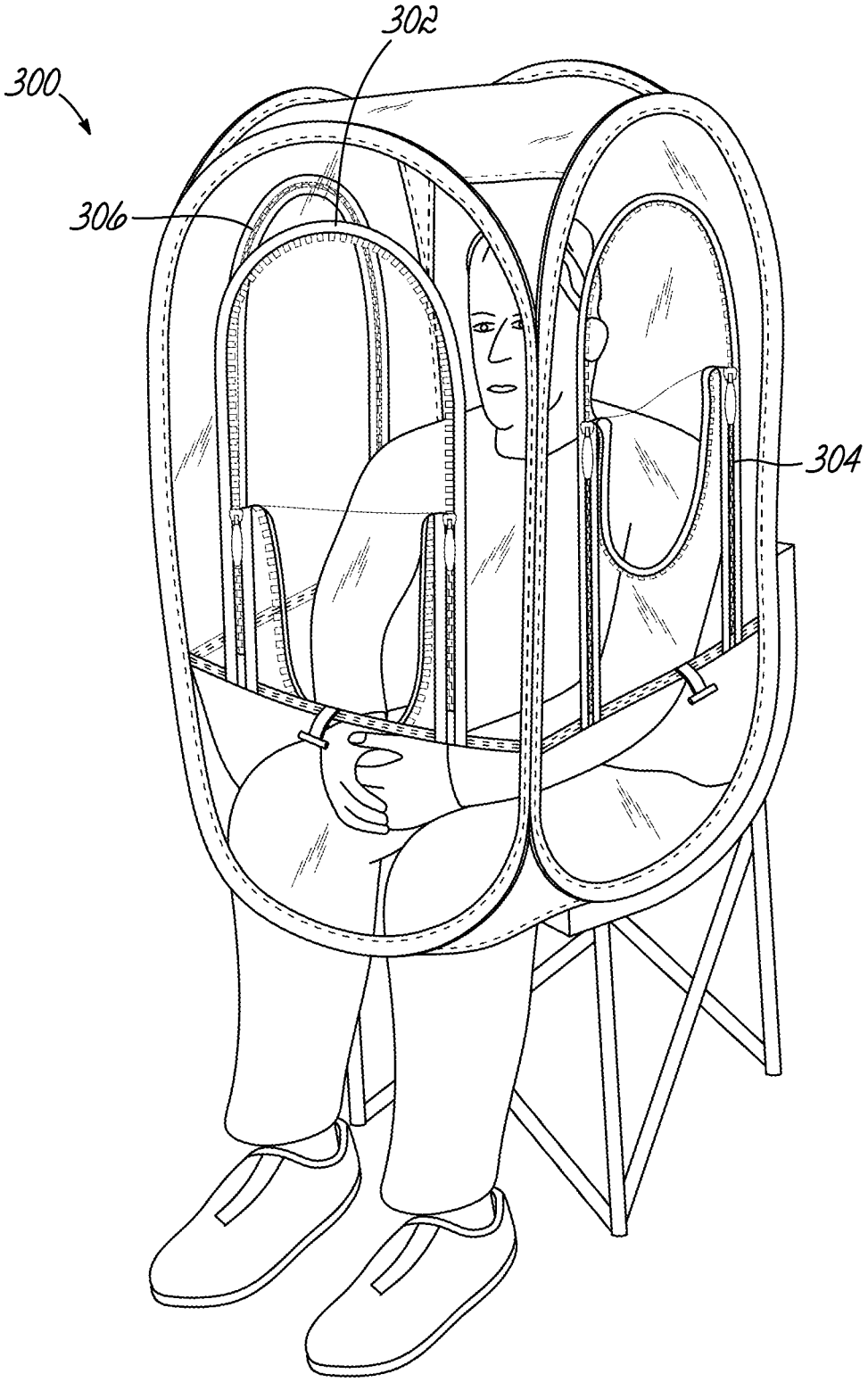
FIG. 24 schematically illustrates an exemplary perspective view of the personal pop-up pod of FIG. 22.

FIGS. 22-24 illustrate an embodiment of a stadium pod 300. The stadium pod includes four transparent side panels and a top panel, which can be either transparent or, as illustrated in the figures, opaque. The transparent side panels and the top panel are made of materials that resist the penetration of water, thus, protecting the user in rainy or snowy weather. Additionally, the side panels and top panel hold in body heat, which increases the temperature within the stadium pod as compared to the ambient temperature. The transparent side panels provide the user with 360 degree viewing so that the user can observe the surrounding activities, such as a sporting event. The side panels can include windows that can be opened and closed using a one or more fasteners, such as zippers 302, 304, 306, so that the user can communicate with persons seated next to the user or receive items, such as food and drink, through the windows. Additionally, a window can be opened to increase ventilation within the stadium pod if desired by the user. The bottom of the stadium pod can be generally open, or can include a flap of material that the user can sit on when seated in a stadium chair or on a stadium bleacher. As illustrated in FIG. 23, the stadium pod is designed so that it accommodates a user, but is not obstructive to those seated next to the user. Additionally, the transparent side panels allow for any person seated behind the user to see though the stadium pod.

Figure 25:
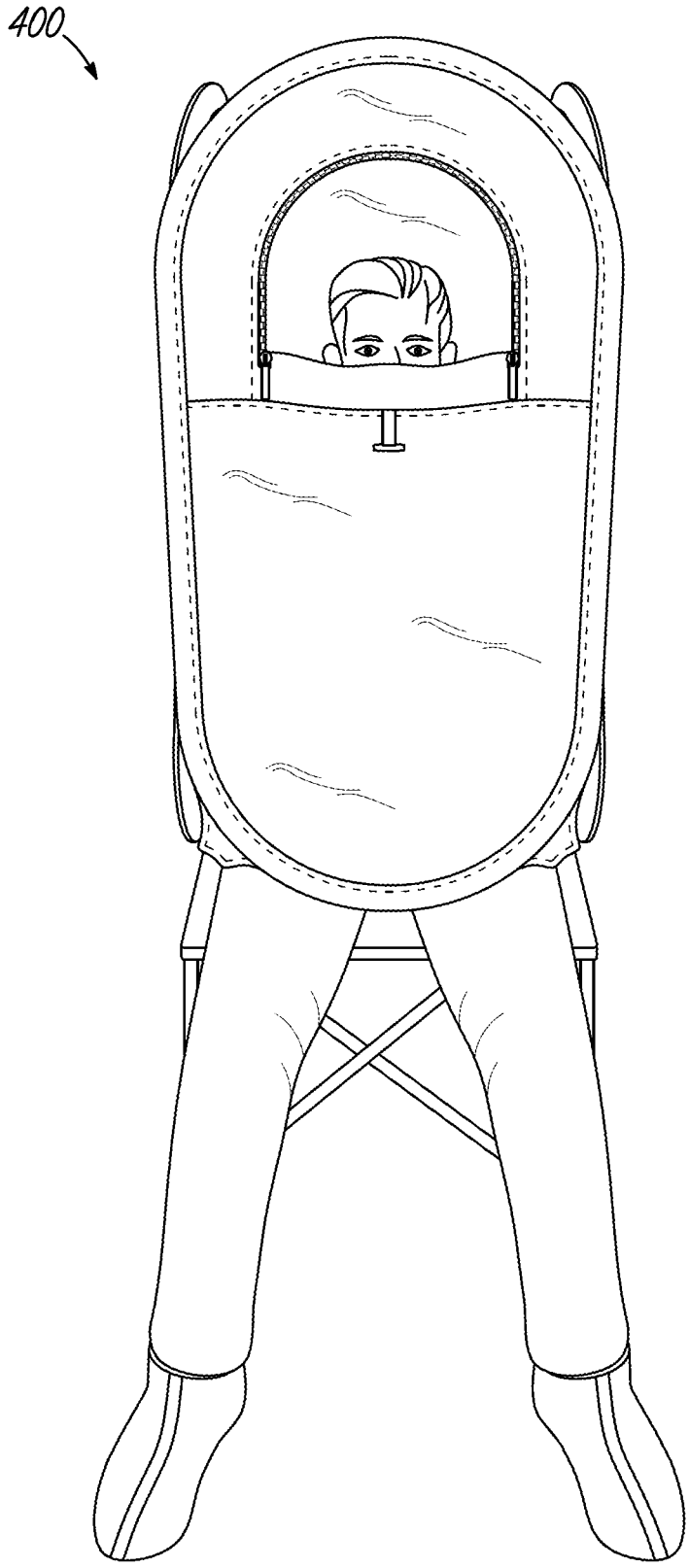
FIG. 25 schematically illustrates an exemplary front perspective view of another personal pop-up pod that accommodates one user.
Figure 26:
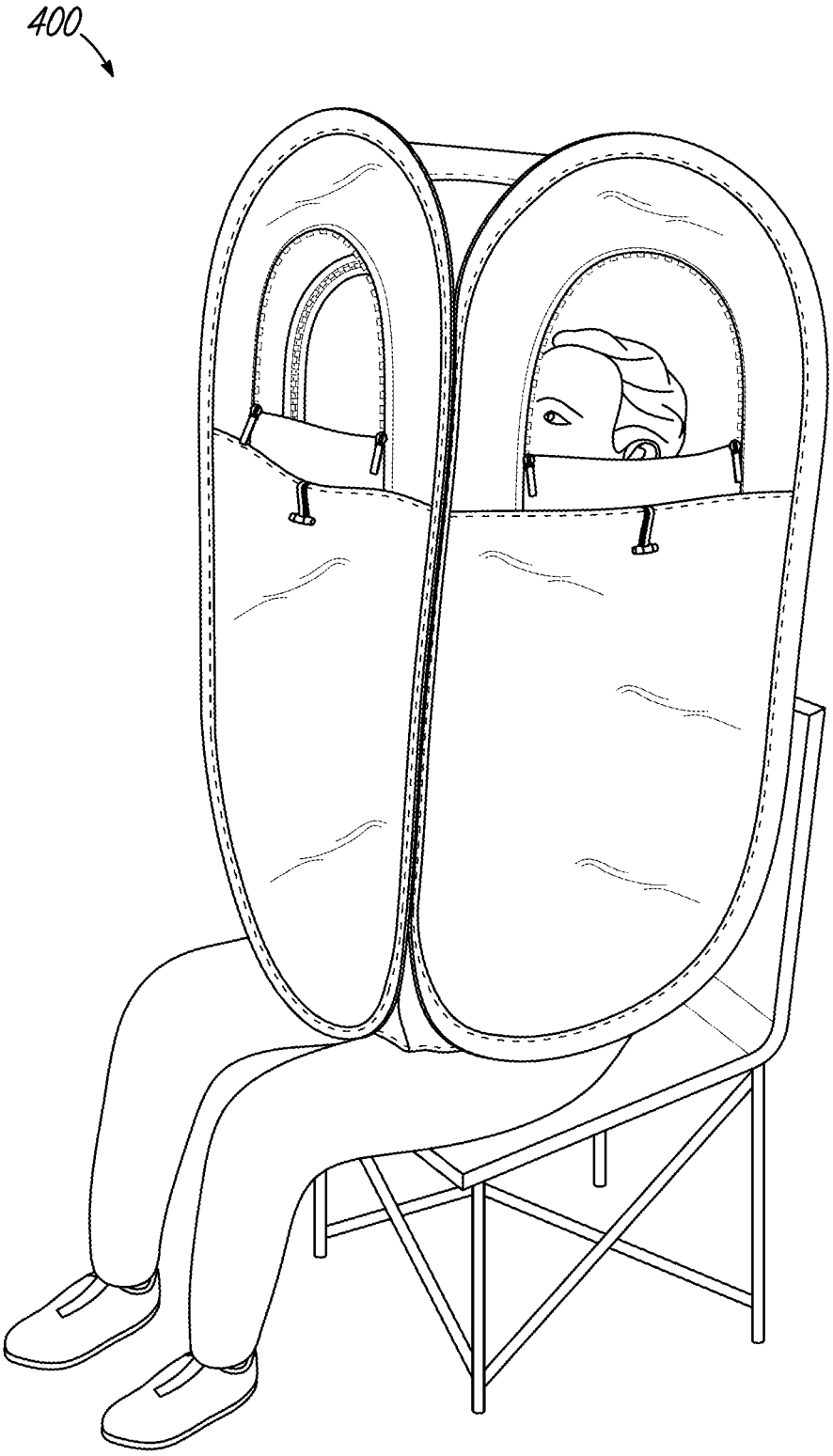
FIG. 26 schematically illustrates a perspective view of the personal pop-up pod of FIG. 25.

FIGS. 25-26 illustrate an embodiment of the travel pod 400. The travel pod includes four opaque side panels and an opaque top panel. Multiple of the side panels can include windows that are opened and closed using fasteners such as zippers. The opaque side panels and top panel can provide the user with privacy as the user travels via publicly available transportation such as airplanes, trains, buses, subways, and the like. Additionally, the side panels and top panel can provide the user with protection against germs and viruses that are commonly spread when person congregate in crowded and enclosed areas. The user can open and close the window are desired. The user can open a window to communicate with persons seated next to the user or to receive items, such as food and drink, through the windows. The bottom of the travel pod is generally open. The travel pod is designed so that it accommodates a user, but is not obstructive to those seated next to the user. The materials used for the side panels and top panels can be arranged to allow the pod to "breath." That is to say that the material allows air to pass through the material to ventilate the travel pod, but does not allow of germs and viruses to penetrate the material.

A mobile pod can be designed generally like the stadium pod; however, the mobile pod can include a support mechanism that is connected to the inside of the mobile pod and engage the user such that the mobile pod is supported by such engagement and remains position about the user as the user moves from one location to another location. The mobile pod includes four side panels and a top panel. The one or more side panels can be transparent. The side panels and top panel are made of material that resists the penetration of water so that the mobile pod protects the user from inclement elements such as snow, rain, and sleet. In one example, the support mechanism can be a pair of straps similar to that of a backpack. A top portion and bottom portion of each strap is attached at the back panel of the mobile pod. In such an arrangement, the user can slide his or her arms through the straps (such is commonly done for a backpack) and tighten the straps to secure the mobile pod to the user's shoulders and back. The user can then freely walk around with the mobile pod secured to the user.

In another example, the support mechanism can be a pair of straps. However, in this example, one end of each strap is attached to the front panel of the mobile pod and the opposite end of each strap can be secured to the back panel of the mobile pod. The straps can be secured in a manner where the user can place the straps on his or her shoulders so that the mobile pod is supported about the user. In another example, the support mechanism can include a waist strap attached to the pair of straps, which is secured about the user's waist. In such an arrangement, the user can then freely walk around with the mobile pod secured to the user.

As previously noted, the mobile pod can be used by workers that have to work in the elements. In one example, a crossing guard can use a mobile pod to perform his or her duties in assisting children and other persons crossing busy streets. The windows can allow the user of the mobile pod to use a hand held stop sign that is common for crossing guards. In another example, a worker at a fast food restaurant can use a mobile pod to move from vehicle to vehicle and take and deliver orders for customers in inclement weather. Again, the windows provide the user with the flexibility to hand out orders and take payment, while still remaining protected by from the elements.

Additional embodiments are disclosed of novel personal pop-up pods designed for a single user, which can provide the user with protection from the surrounding elements, including airborne communicable diseases, while allowing the user to remain mobile, i.e., allow the user to move from location to location by walking or any other common mobile methods, and further allowing the user to use his or her arms and hands to complete manual tasks. It will be appreciated that devices and products that limit the spread of recurring communicable diseases such as influenza, the common cold, and chickenpox, as well as new threats such as coronavirus (also referred to as SARS-CoV-2) can be critical in controlling the spread of such harmful and potentially fatal diseases. Such devices and products ultimately save lives.

The personal pop-up pods disclosed herein are designed to facilitate various activities, such as the provision of professional services, while provided protection for both the user and those persons located proximate to the user. For example, the personal pop-up pod can be used by medical professionals that are in close proximity to patients that may be inflicted with communicable diseases. In one example, an intake administrator at an emergency room or generally at a health care facility who interacts with newly arrived patients can wear a personal pop-up pod while engaging with such patients to minimize the threat of exposure to communicable diseases carried by the patients. The personal pop-up pod is designed so that the user is free to use his or her arms and hands to complete manual tasks such as writing down information, operating a hand-held electronic device, administering testing such as blood pressure and temperature measurements, and the like. As will be understood, once a patient is admitted to a health care facility, those medical professionals that further interact with the patient that is suspected of having a communicable disease can similarly wear a personal pop-up pod for protection against the communicable disease. For example, doctors, nurses, orderlies, food delivery personnel, cleaning personnel, etc. that work in areas of a health care facility dedicated to treating patients with communicable diseases can as a matter of routine perform their duties wearing a personal pop-up pod. In another example, food processing, handling, and preparation professionals can wear personal pop-up pods to shield the food products being prepared from potential communicable diseases carried by the food processing, handling, and preparation professionals. While it is becoming common practice for employees to refrain from going to work once they experience symptoms of a communicable disease, certain such diseases can be communicable prior to an inflicted person showing any symptoms. Thus, those that work in industries where diseases can be spread quickly to those persons consuming the industries' products (such as food processing, handling, and preparation) should take necessary precautions to prevent the spread of such diseases. One such precaution is to perform their jobs while using a personal pop-up pod to shields the products from a worker's communicable disease. Select examples of such jobs are workers employed by food manufacturers, grocery store employees, and cooks in restaurants. It will be understood that these are mere examples of the myriad of uses for personal pop-up pods as disclosed herein.

Figure 27:
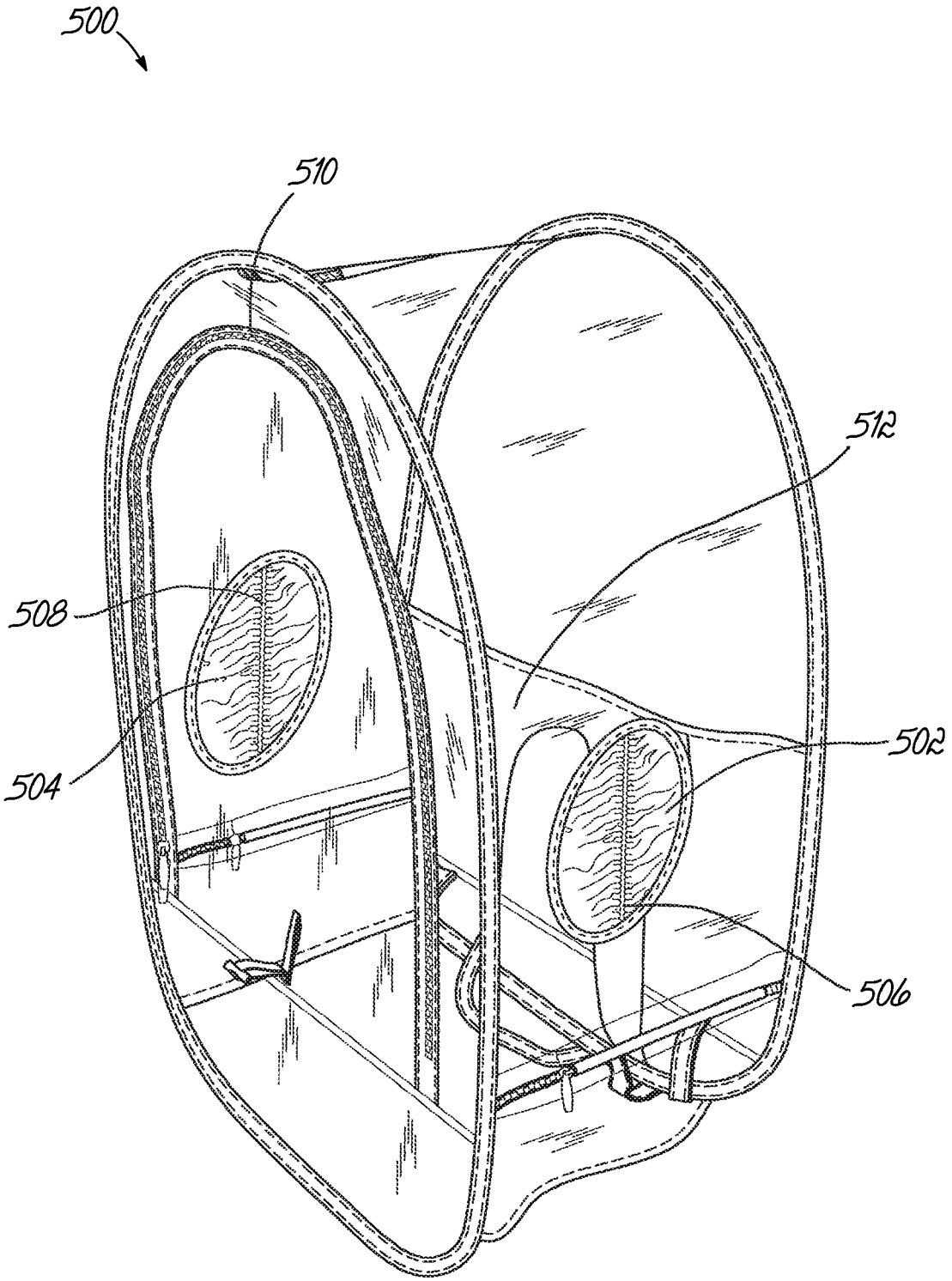
FIG. 27 schematically illustrates a perspective view of a personal pop-up pod.
Figure 28:
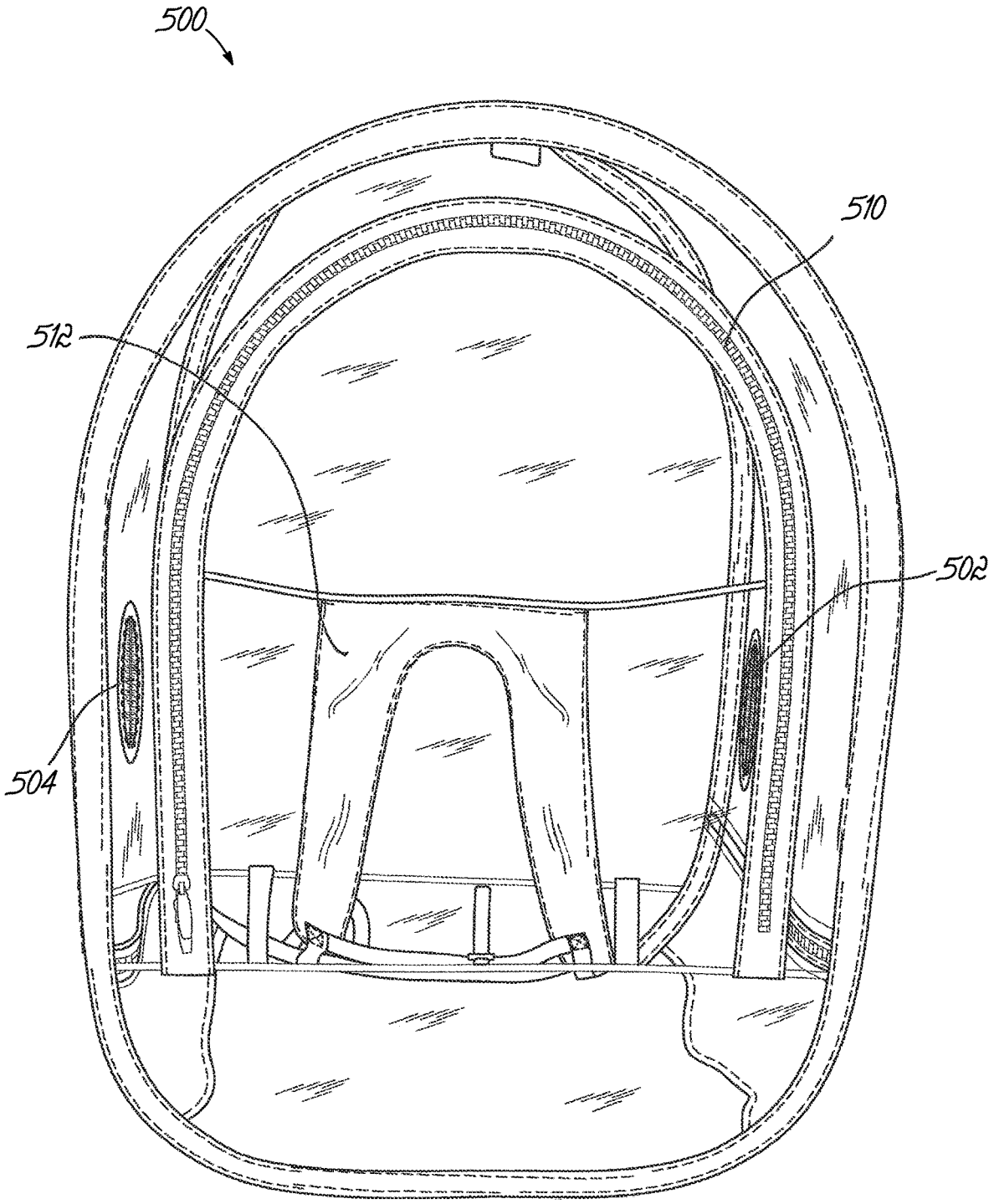
FIG. 28 schematically illustrates a front view of the personal pop-up pod of FIG. 27.
Figure 29:
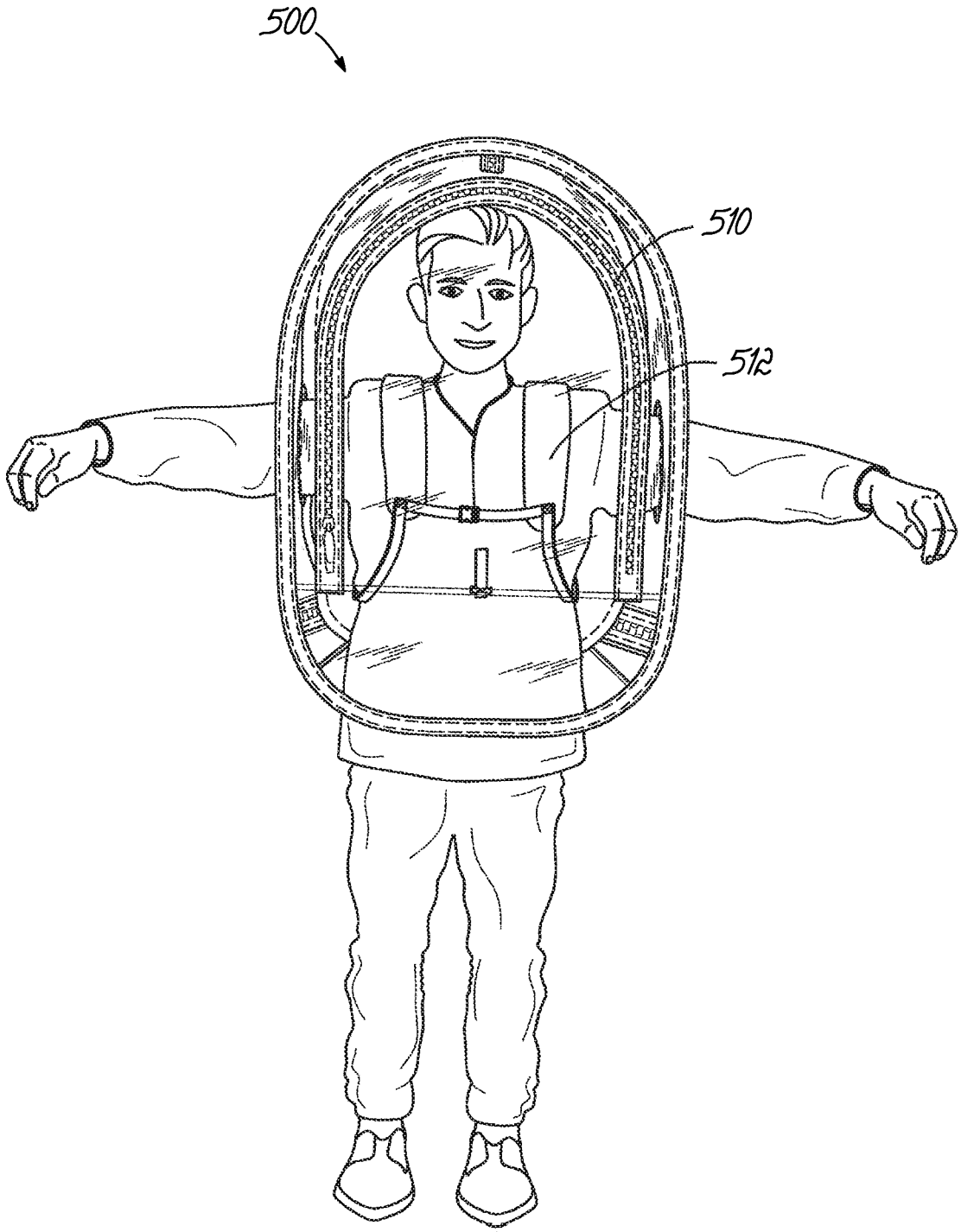
FIG. 29 schematically illustrates a user using the personal pop-up pod of FIG. 27.
Figure 30:
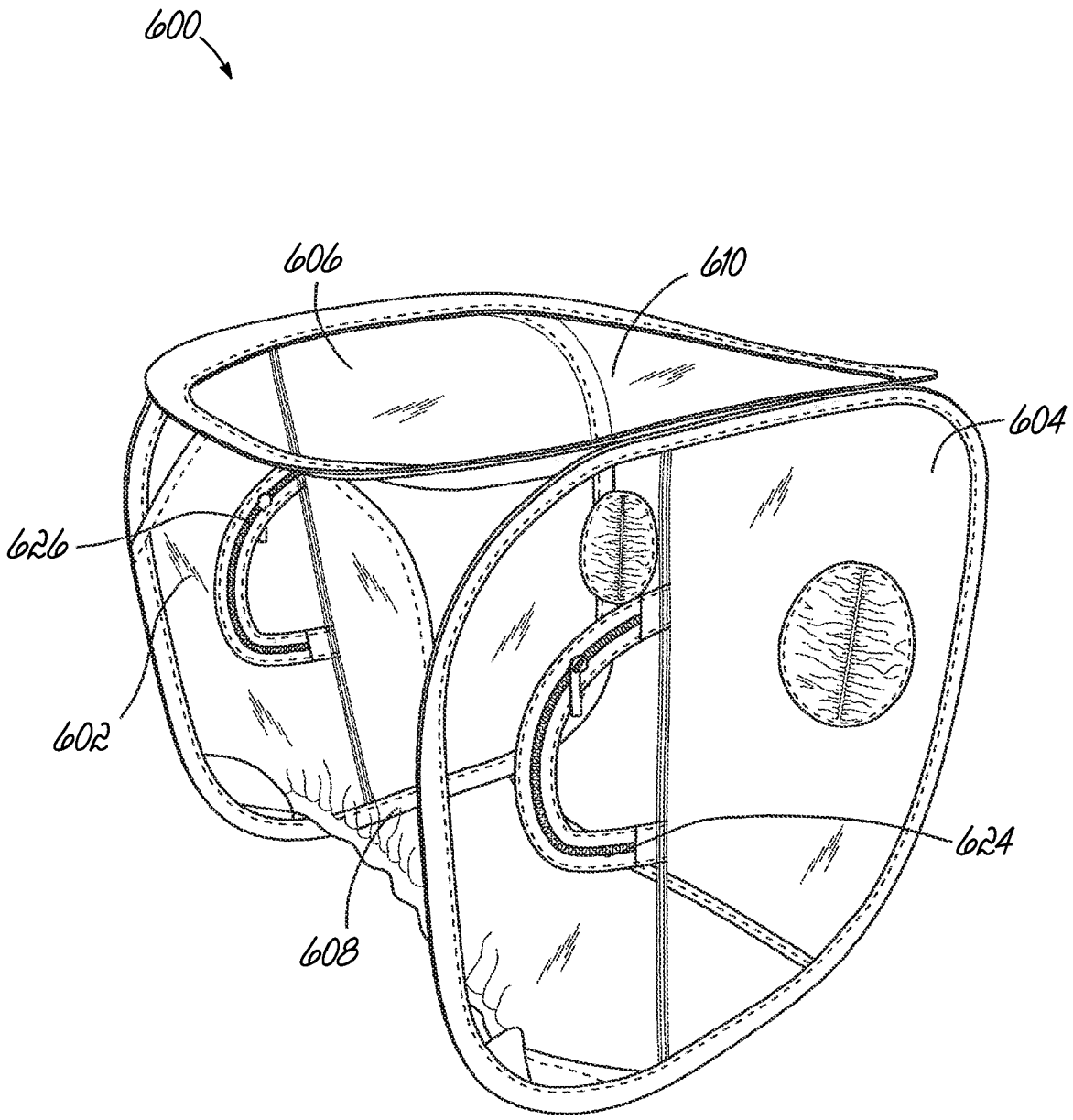
FIG. 30 schematically illustrates a perspective view of a personal pop-up pod.
Figure 31:
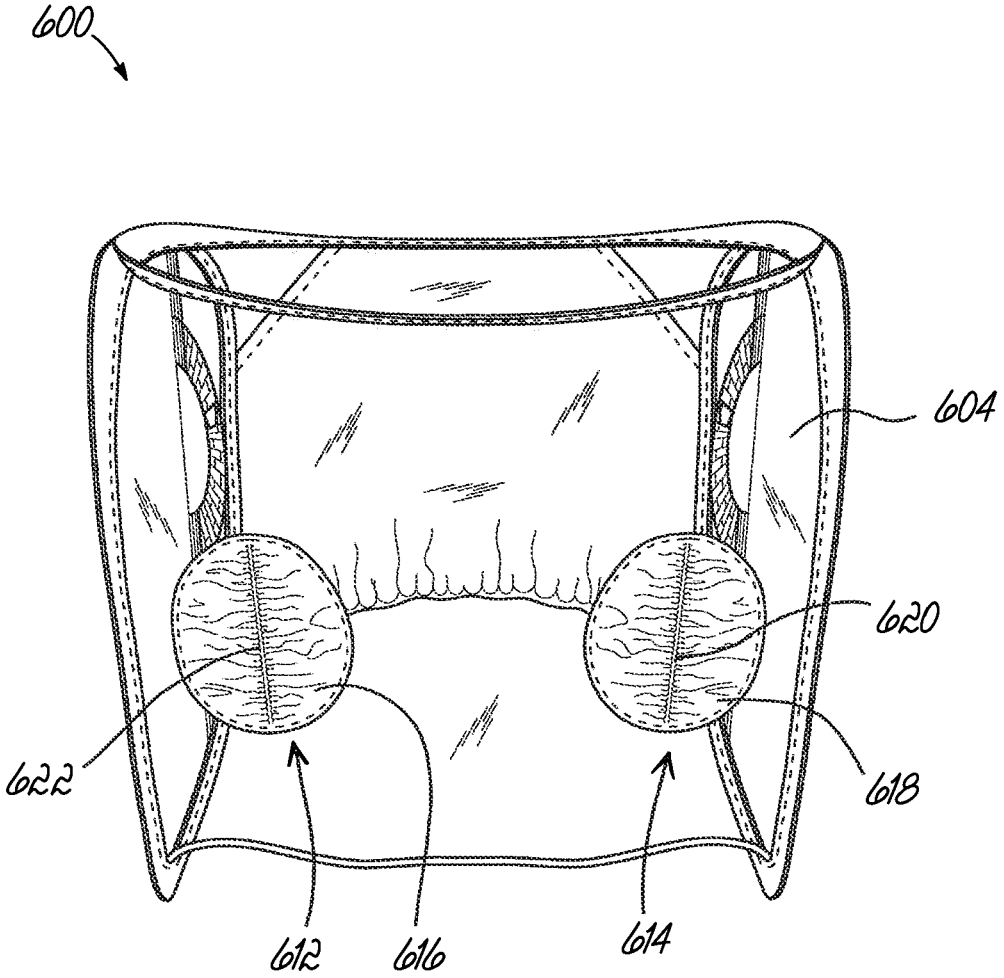
FIG. 31 schematically illustrates a rear view of the personal pop-up pod of FIG. 30.
Figure 32:
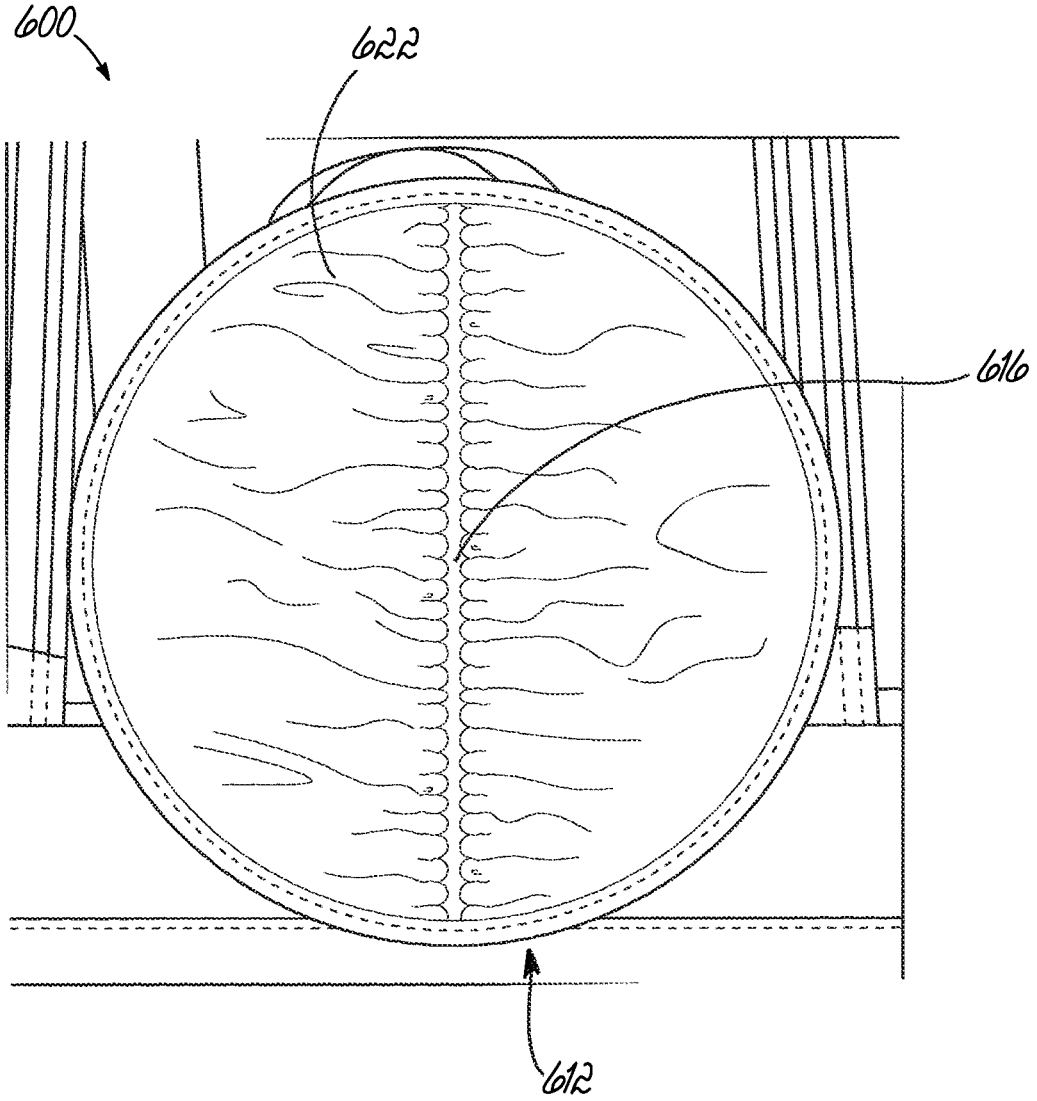
FIG. 32 schematically illustrates an access slot incorporated into the personal pop-up pod of FIG. 30.

As shown in FIGS. 27-29, a personal pop-up pod 500 can be designed with four sides (e.g., a front side, a rear side, a left side, and a right side), a top and a bottom. The four sides and top can be constructed of a clear material, or in the alternative, can be constructed of a combination of clear and opaque materials. In an embodiment, the materials used can be treated with anti-microbial agents to further protect the user. Two of the sides, such as the left side and right side, can include arm holes 502 and 504 that provide the user of the personal pop-up pod 500 with the opportunity to extend his or her arms outside the personal pop-up pod 500 when the personal pop-up pod 500 is carried by a user. As shown in the figures, the arm holes 502 and 504 can be a generally round section of material with a vertical slit 506, 508 bisecting the round section. As previously described, the slit of the arm holes 502 and 504 can include two edges that have elastic bands running along the edges. The user's arms can be extended though the slits, which are designed to comfortably engage the user's arms so that the side is generally sealed while still providing the user the freedom to move his or her arms as required to perform manual tasks. In one embodiment, the arm holes 502 and 504 can be positioned substantially closer to the front side than the rear side of the personal pop-up pod 500 to make it easier for a user to perform manual tasks without the front side of the personal pop-up pod 500 interfering with the task.

Sides (such as the front side) can include a zipper 510 that can be zipped and unzipped and allow a flap of material to be moved to either expose or seal that side of the personal pop-up pod 500 from the surrounding environment. It will be understood that such zipper 510 can be unzipped at the user's discretion to configure the personal pop-up pod 500 to suit the user's needs for access to the environment surrounding the user and the personal pop-up pod 500. When the zipper 510 is zipped, the front side will be sealed from the surrounding environment. When the zipper 510 is unzipped, the user will have access to the surrounding environment through the front side of the personal pop-up pod 500. It will be understood that when the user is not in an environment where communicable diseases are a threat, the front side can be unzipped to allow the user greater access to perform certain tasks.

The bottom of the personal pop-up pod 500 can be fully open. Such an arrangement can facilitate greater movement of the user relative to the personal pop-up pod 500 and can add comfort for the user during the use of the personal pop-up pod. In another embodiment, the bottom can include a section of material that includes a generally circular opening in the center of the section of material. The circular opening can include an elastic band about the perimeter of the opening. Either a fully open bottom or one with a circular opening allows a user to slide the personal pop-up pod 500 over the user's head and downward until the user is situated in the personal pop-up pod 500. In the embodiment with the circular opening, the elastic band can fit snuggly about the user's waist or upper legs to further protect the user. It will be understood that the user can remove the personal pop-up pod 500 in a similar fashion by moving the personal pop-up pod upwardly over the user's head until the personal pop-up pod 500 is removed from the user.

As best seen in FIG. 28 and FIG. 29 (which shows a user carrying the personal pop-up pod 500), the personal pop-up pod 500 includes a harness 512. In one embodiment, the harness 512 is secured to the inside surface of the rear side of the personal pop-up pod 500. In another embodiment, the harness 512 is secured, at least partially, to the intersections of the rear side and the left and right sides. The harness 512 includes a pair of upper shoulder straps, each connected to an adjustable lower strap, to fit and secure the harness 512 to a user's upper body. Additionally, the harness 512 can include a horizontal cross strap that optionally connect the two shoulder straps to further secure the harness 512 to the user's upper body. When a user slides the personal pop-up pod 500 over the user's head and moves the personal pop-up pod 500 downward, the user can place an arm through each side of the harness 512 and position the harness 512 on the user's shoulder in a manner such that the personal pop-up pod 500 is fully supported by the engagement of the harness 512 and the user's shoulders. The harness 512 can include pull tabs that can be pulled to take up any slack in the harness 512 and snuggly secure the harness 512 to the user's shoulders and upper body.

Once the harness 512 is snuggly secured to the user's shoulders and upper body, it will be understood that the personal pop-up pod 500 will generally move with the user, including moving in the same direction and distance as the user's forward and backward motion, side to side motion, twisting or rotating motion, and up and down motion. When the user is engaged with the harness 512 and the personal pop-up pod 500 is carried by the user, it will be understood that the rear side of the personal pop-up pod 500 will generally be in contact with or very close to the user's back and there will be gaps or spaces between the user's body and the front side, left side, and right side of the personal pop-up pod 500. While the attachment mechanism of the personal pop-up pod is illustrated and described as a harness, it will be understood that other attachment mechanisms can be used. For example, two independent straps can be used in place of a harness.

In one embodiment, the rear side of the personal pop-up pod 500 can be arranged as one continuous clear panel. In another embodiment, the rear side can be arranged to an open section to facilitate airflow through the personal pop-up pod 500. For example, the section above the attachment of the harness 512 can be open. Such an arrangement may be convenient for jobs that are physically strenuous and/or require rapid movement from one location to another.

Referring again to FIG. 29, a user is shown carrying the personal pop-up pod 500 with the harness 512 positioned across the user's shoulders, with the horizontal cross strap connecting the two shoulder straps. The user's arms are extending through arm holes holds 502 and 504 on either side of the personal pop-up pod 500 and positioned to perform manual tasks.

In one embodiment, the height of the personal pop-up pod is about 32 inches, the width (from left side to right side) is about 22 inches, and depth (from front side to rear side) is about 14 inches. These dimensions are but one example of sizing for a personal pop-up pod. It will be understood that other dimensions can be used to accommodate different sized users along with different tasks.

It will be understood that the range of motion provided by the arm holes and the personal pop-up pod in general, allows the user to accomplish any number of physical tasks. For example, a medical professional can interact with a patent to perform testing or take notes pertinent to the patients treatment. A worker in a food manufacturing plan can operate machines, package food, etc. A grocery clerk can stock shelves and interact with customers. A restaurant worker can prepare food and deliver food to patrons. The zipper in the front side can be optionally unzipped as required to perform certain tasks.

As will be understood, the materials comprising the sides, top, and bottom are made of material that resists the penetration of airborne pathogens. With regard to the harness, a top portion and bottom portion of the harness can be attached at the rear side of the personal pop-up pod. In such an arrangement, the user can slide his or her arms through each side of the harness (such is commonly done for a backpack) and tighten the straps to secure the personal pop-up pod to the user's shoulders and back. The user can then freely walk about with the personal pop-up pod secured to the user.

Additional embodiments are disclosed of novel personal pop-up pods designed for use by a patient in a medical facility. The pop-up pods can provide the patient and medical professionals attending to the patient with protection from the transmission of diseases, including airborne communicable diseases. The novel personal pop-up pods allow for medical professionals to have access to the patient to perform medical examinations or medical procedures while providing both patients and medical professionals with such protection from communicable diseases.

As previously noted, devices and products that limit the spread of recurring communicable diseases can be critical in controlling the spread of such harmful and potentially fatal diseases. Such devices and products used regularly and effectively slow or stop the spread of communicable diseases and ultimately save lives. One general method of controlling the spread of communicable diseases is to create a physical barrier between persons situated proximate to each other while facilitating interactions between the persons required to accomplish certain critical tasks. Regardless of the situation, the provision of medical care to ill patients is a critical task that must be carried out by medical professionals despite the risks of communicable diseases.

The personal pop-up pods disclosed herein are designed to facilitate various activities, such as the provision of medical services, while providing protection for both a patient and medical professionals located proximate to the patient. For example, the personal pop-up pod can be fitted to a patient that is to undergo a medical examination or medical procedure. The personal pop-up pod is designed so that the medical professionals is provided with access to the patient. Such access can be facilitated by one or more access points in the personal pop-up pod that allows the medical professional to insert his or her hands and arms or medical instruments into the personal pop-up pod to gain access to the patient to perform the required medical examination or medical procedure.

As depicted in FIGS. 30-34, a personal pop-up pod 600 can be designed to be generally cubic-shaped with an interior portion of the personal pop-up pod 600 defined by five panels (e.g., a front panel 602, a rear panel 604, a left panel 606, a right panel 608, and a top panel 610). The section opposite the top panel 610 is generally open. The five panels (602, 604, 606, 608, and 610) can be constructed of a clear material, or in the alternative, can be constructed of a combination of clear and opaque materials. In one embodiment, the materials that comprise the panels (602, 604, 606, 608, and 610) and the pop-up pod 600 in general can be treated with anti-microbial agents to further protect the patient and medical professionals.

The personal pop-up pod 600 can include access slots incorporated into the personal pop-up pod 600. In one example (best depicted in FIGS. 31 and 32), two access slots 612 and 614 are incorporated into the rear panel 604 of the personal pop-up pod 600. The access slots 612 and 614 provide medical professionals access to the interior of the personal pop-up pod 600. As depicted in the figures, the access slots 612 and 614 can each include a generally round section of material (616 and 618) with a vertical slot (620 and 622) bisecting the round section of material (616 and 618). The vertical slots (620 and 622) can include two edges that have an elastic band running along each edge. The medical professional can insert his or her arms through the vertical slots (620 and 622), which are designed to comfortably engage the medical professional's arms so that the vertical slot (620 and 622) is generally sealed about the medical professional's arm while still providing the medical professional the freedom to move his or her arms as required to perform needed manual tasks within the personal pop-up pod 600. In addition to accommodating the arms of a medical professional, the access slots (612 and 614) can accommodate medical instruments such as, for example, an endoscope, a biopsy device, portions of a ventilator, and the like. Thus, a medical professional can use the access slots (612 and 614) to manually examine or perform a medical procedure on a patient fitted with the personal pop-up pod 600.

The personal pop-up pod 600 can additionally include access windows incorporated into the personal pop-up pod 600. In one example (best depicted in FIG. 30), a first access window 624 is incorporated into the left panel 606 and a second access window 626 is incorporated into the right panel 608 of the personal pop-up pod 600. Each access window (624 and 626) is comprised of a generally semi-circular zipper that can be zipped and unzipped to allow a generally semi-circular flap of material to be moved to either expose or seal that left panel 606 or right panel 608 (respectively) of the personal pop-up pod 600 from the surrounding environment. It will be understood that such zippers can be unzipped at a medical professional's discretion to configure the personal pop-up pod 600 to suit the medical professional's needs for access to the interior portion of the personal pop-up pod. Similar to the access slots (612 and 614), the access windows 624 and 626 provide medical professionals access to the interior of the personal pop-up pod 600 so that the medical professional can insert his or her arms or a medical instrument or device into the personal pop-up pod as required to perform needed manual tasks or procedures to the patient within the personal pop-up pod 600. It will be understood that as depicted in the figures, the access windows 624 and 626 are larger than the access slots 612 and 614 and thus, can accommodate larger medical instruments and devices than the access slots 612 and 614.

Figure 33:
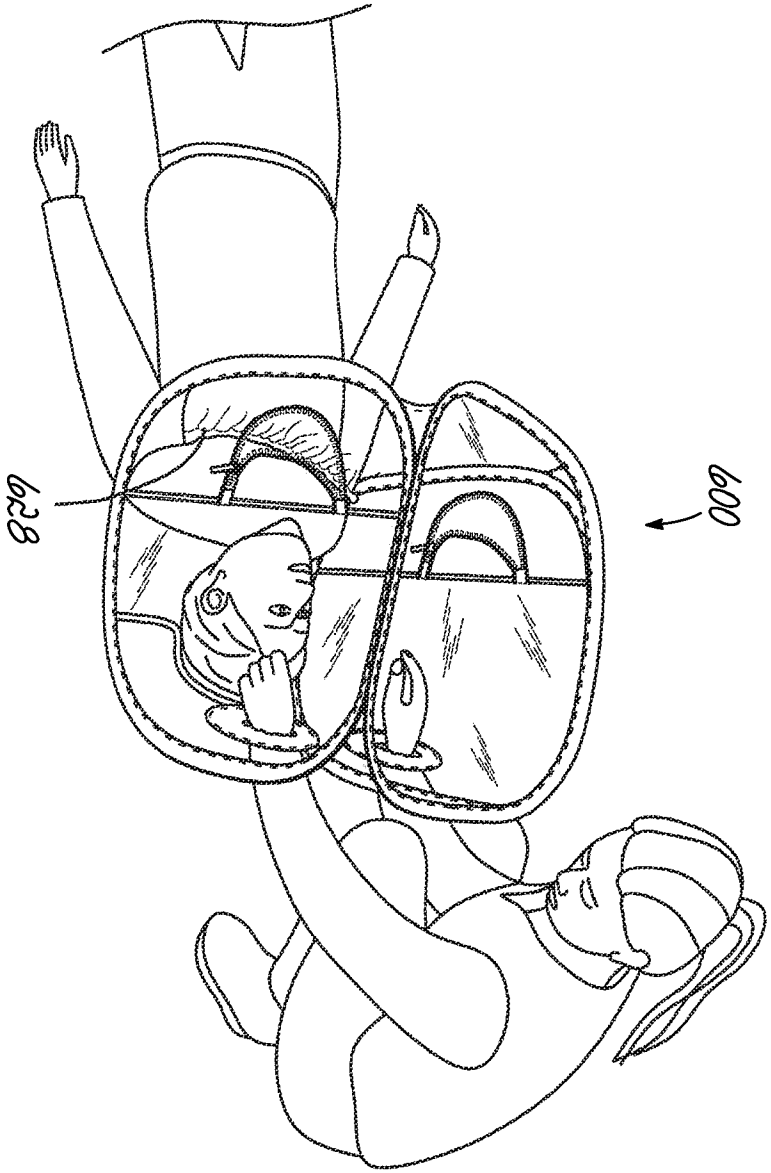
FIG. 33 schematically illustrates a side perspective view of the personal pop-up pod of FIG. 30 fitted to a patient and a medical professional accessing the interior via access slots.
Figure 34:
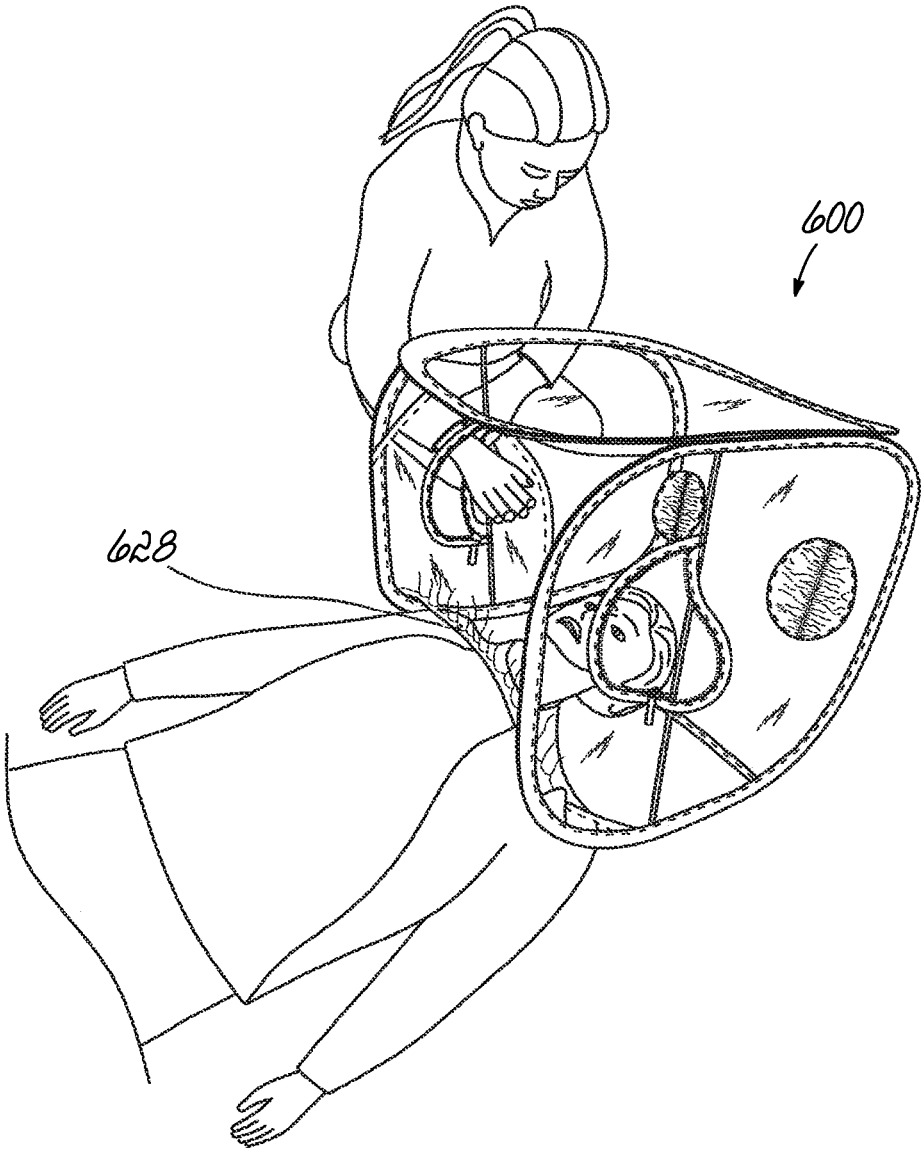
FIG. 34 schematically illustrates a front perspective view of the personal pop-up pod of FIG. 30 fitted to a patient and a medical professional accessing the interior via access windows.

FIGS. 33 and 34 depict the personal pop-up pod 600 fitted to a patient with a medical professional attending to the patient. As previously noted, the section opposite the top panel 610 is generally open. However, as depicted in FIGS. 33 and 34, a lower portion of the rear panel 604 curls under so that it is positioned under the patient's head. The front panel 602 includes a lower edge 628 that engages the torso of the patient. The lower edge 628 includes an elastic band running along the lower edge 628 so that the front panel 602 can seal along the patient's torso. It will be understood that the lower portion of the rear panel 604 curling under the patient's head and the lower edge 628 of the front panel 602 sealing against the patient's torso work in cooperation to generally seal the interior section of the personal pop-up pod 600 about the patient's head and upper torso.

With reference to FIG. 33, a medical professional can insert his or her arms through the access slots 612 and 614 to access the patient to administer medical treatment. With reference to FIG. 34, a medical professional can insert his or her arms through the access windows 624 and 626 to access the patient to administer medical treatment. It will be understood that medical professionals can administer medical treatment as depicted in FIGS. 33 and 34 while remaining safe from communicable diseases carried by the patient, and conversely, the patient remains safe from communicable diseases carried by the medical professional.

Figure 35:
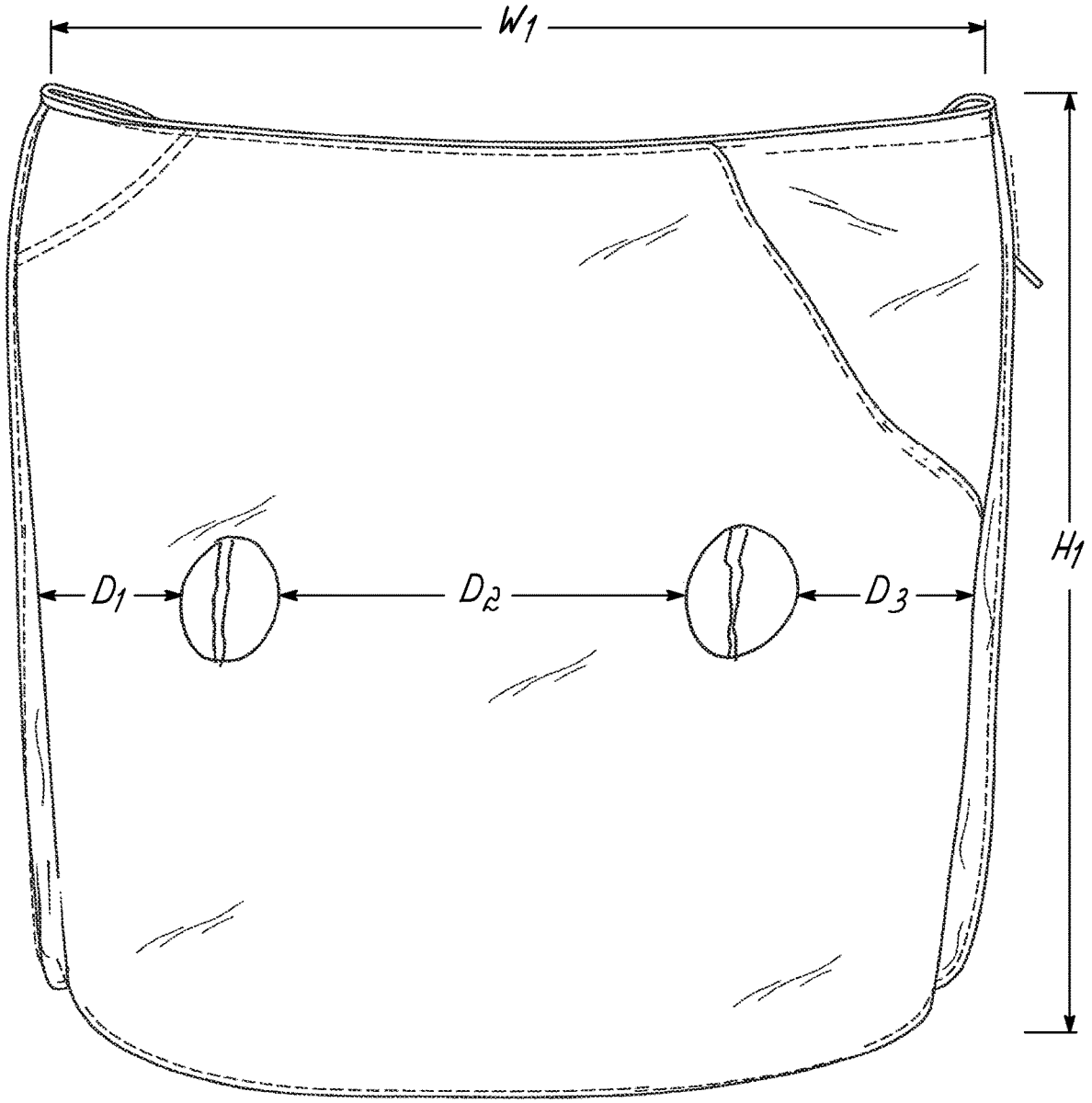
FIG. 35 schematically illustrates dimensions and access slot placement for a personal pop-up pod.
Figure 36:
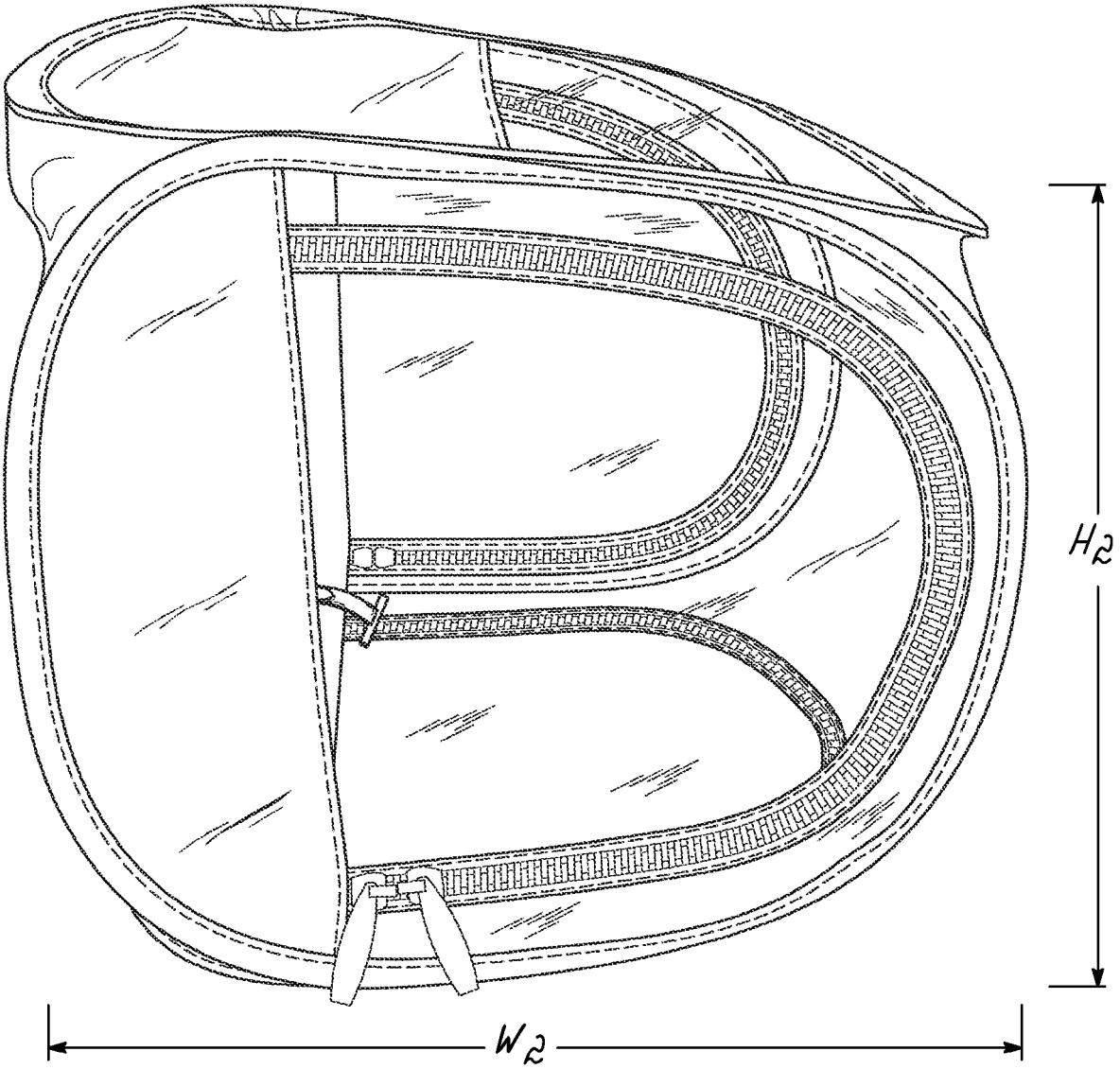
FIG. 36 schematically illustrates dimensions for the personal pop-up pod of FIG. 35.

FIGS. 35 and 36 depicted dimensions and access slot positions for one embodiment of a personal pop-up pod. In this embodiment, the rear panel (as depicted in FIG. 35) is approximately eighteen inches in height ($H_1$) and twenty-one inches in width ($W_1$). The access slots are located at the approximate vertical midpoint of the rear panel and each access slot is located approximately three inches ($D_1$, $D_3$) for the respective vertical edge of the rear panel. The pair of access slots are located approximately eight inches apart ($D_2$) from each other. In this embodiment, the left panel (as depicted in FIG. 36) is approximately eighteen inches in height ($H_2$) and eighteen inches in width ($W_2$).

Figure 37:
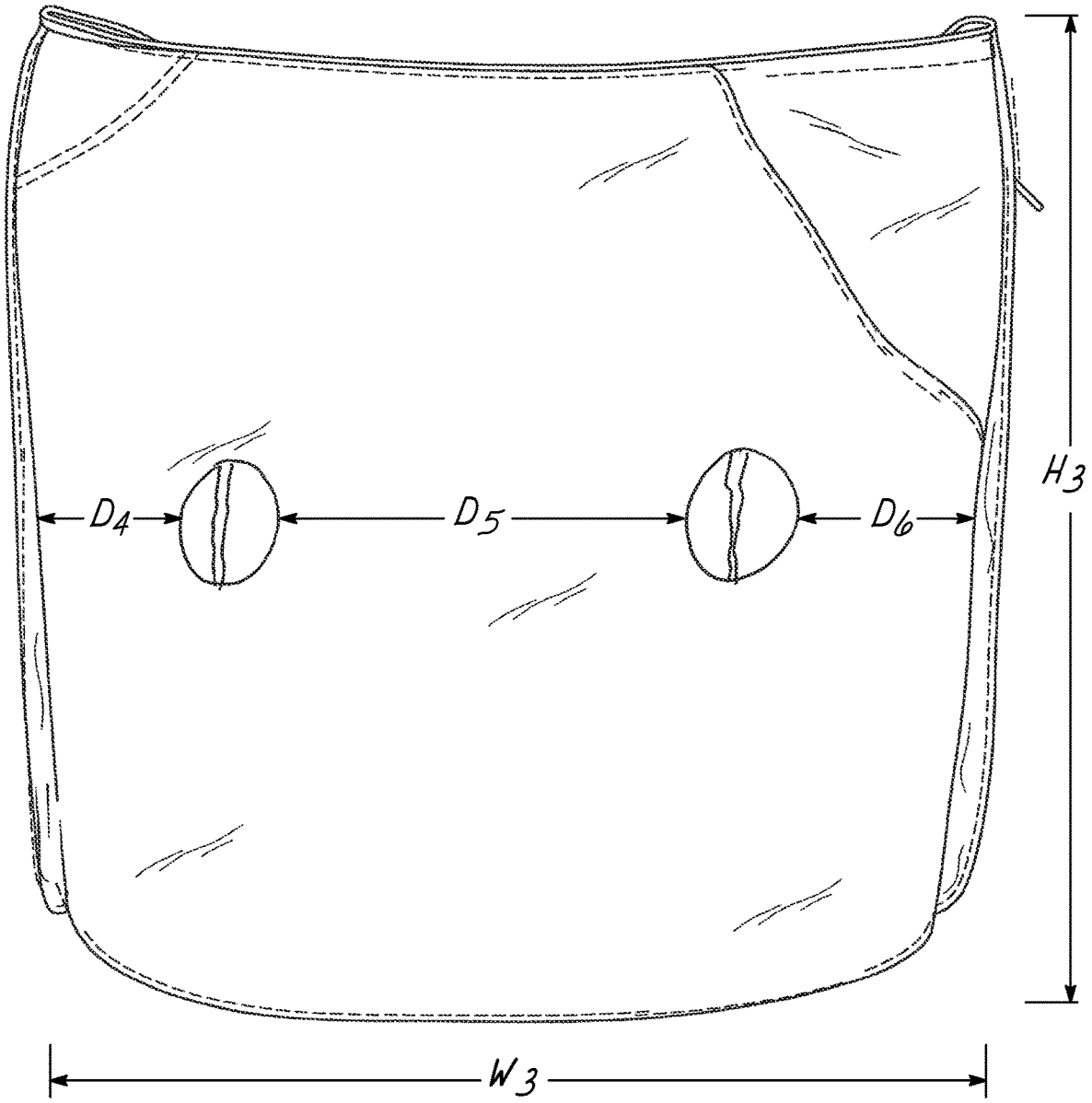
FIG. 37 schematically illustrates dimensions and access slot placement for a personal pop-up pod.
Figure 38:
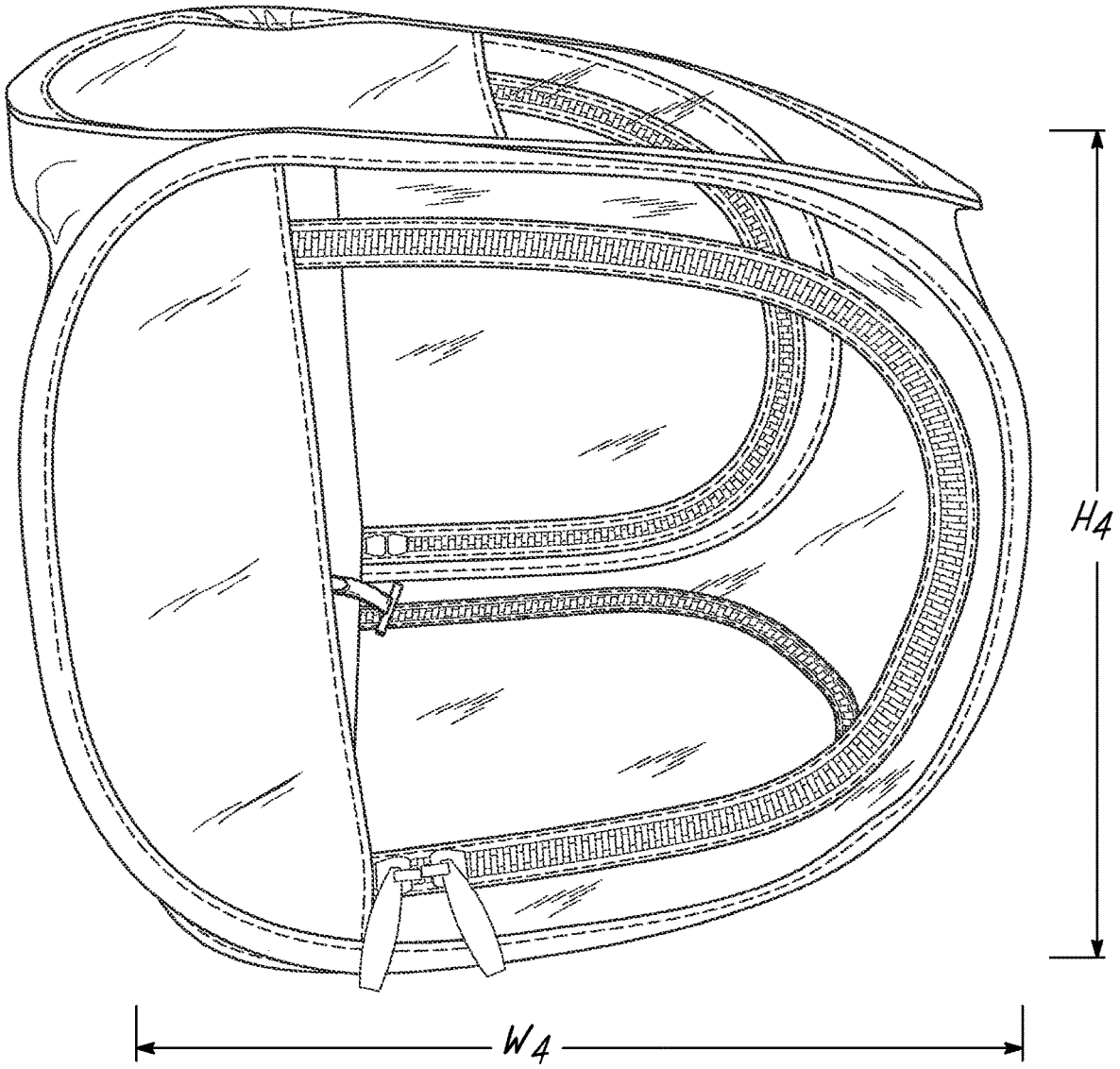
FIG. 38 schematically illustrates dimensions for the personal pop-up pod of FIG. 37.

FIGS. 37 and 38 depicted dimensions and access slot positions for another embodiment of a personal pop-up pod. In this embodiment, the rear panel (as depicted in FIG. 37) is approximately twenty-one inches in height ($H_3$) and twenty-one inches in width ($W_3$). The access slots are located at the approximate vertical midpoint of the rear panel and each access slot is located approximately three inches ($D_4$, $D_6$) for the respective vertical edge of the rear panel. The pair of access slots are located approximately eight inches apart ($D_5$) from each other. In this embodiment, the left panel (as depicted in FIG. 38) is approximately twenty-one inches in height ($H_4$) and eighteen inches in width ($W_4$).

In another embodiment an additional access window is positioned in the top panel of the personal pop-up pod. Such an access window can be zipped and unzipped by a medical professional to gain access to the patient's torso from directly above the patient's torso. As will be understood, the materials comprising the panels can be made of material that resists the penetration of airborne pathogens. The access windows can be equipped with zippers that seal the access windows when closes to resist the passing of pathogens through the zipper. Additionally, a flap of material can be positioned over the zippers to further resist the passing of pathogens through the zipper.

In another embodiment, a vacuum pump or other negative pressure device can be used with the personal pop-up pod. In such an embodiment, a port can be integrated into any of the panels of the personal pop-up pod and arranged to engage with one end of a hose, tubing, or other suitable conduit. The other end of the hose can be engaged with the vacuum pump. The medical professional can selectively initiate the vacuum pump to draw air out of the personal pop-up pod through the port in a panel of the personal pop-up pod. It will be understood that such a process can evacuate air from the interior of the personal pop-up pod, which includes evacuating pathogens carried by the patient capable of transmitting communicable diseases to persons proximate to the patient. The vacuum pump or negative pressure device can include a filter capable of capturing such pathogens to substantially curb the potential for transmission of communicable diseases. It will be understood that such a process can make attending to a patient safer, particularly when the medical professional is using access windows out of necessity to insert larger medical instruments or devices into the personal pop-up pods.

It will be understood that the personal pop-up pods disclosed herein may be a disposable device that is used once and discarded or can be a reusable device. The materials comprising the personal pop-up pods are the type that can be disinfected by the application of liquid disinfecting agents. Once disinfected, the personal pop-up pod can be folded and stored and reused in a future procedure.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

I claim:

1. A personal pop-up pod comprising:

an interior chamber formed by a connection of a front panel, a rear panel, a left side panel, a right side panel, and a top panel, the interior chamber also being bounded by an open bottom opposite the top panel;

a first arm aperture formed in the rear panel;

a second arm aperture formed in the rear panel;

a window in the left side panel; and a zipper arranged to open and close the window, wherein a bottom edge of the front panel includes an elastic strip positioned along the bottom edge such that the bottom edge of the front panel may closely conform around a neck or shoulder region of a patient when the personal pop-up pod is placed such that the interior chamber is on top of and encloses the patient's head.

2. The personal pop-up pod of claim 1, wherein a bottom section of the rear panel curls inward toward the interior chamber.

3. The personal pop-up pod of claim 1, further comprising a window in the right side panel.

4. The personal pop-up pod of claim 3, further comprising a zipper arranged to open and close the window.

5. The personal pop-up pod of claim 4, wherein the window in each of the left side panel and the right side panel defines a larger-sized opening than the first slit and the second slit, such that the windows can accommodate larger medical devices and instruments for work in the interior chamber.

6. The personal pop-up pod of claim 5, wherein the zipper for each of the windows follows a semi-circular path such that the window in each of the left side panel and the right side panel is defined by a semi-circular flap of material.

7. The personal pop-up pod of claim 4, further comprising an additional access window positioned in the top panel, with a zipper that opens and closes to selectively open and close the additional access window in the top panel, and a further flap of material is positioned over the zipper to resist transmissions of airborne pathogens through the zipper at the top panel.

8. The personal pop-up pod of claim 1, wherein the front panel, the rear panel, the left side panel, the right side panel, and the top panel collectively define a cubic shape for the interior chamber and the pop-up pod, with each of the panels connected to adjacent panels by discrete edge or corner junctions that help define the cubic shape.

9. The personal pop-up pod of claim 1, wherein each of the front panel, the rear panel, the left side panel, the right side panel, and the top panel are formed from materials that resist penetration and transmission of airborne pathogens and liquids.

10. The personal pop-up pod of claim 1, further comprising a negative pressure device operatively connected to a port located in one of the panels defining the interior chamber, the negative pressure device selectively drawing air from the interior chamber to evacuate airborne pathogens from the patient being treated while also drawing flow of air towards the interior chamber through any openings in the panels.

11. The personal pop-up pod of claim 1, wherein the rear panel defines a height of about 18 inches and a width of about 21 inches, with the first and second arm apertures positioned about 3 inches from corresponding vertical edges of the rear panel and positioned at an approximate vertical midpoint of the height of the rear panel.

12. The personal pop-up pod of claim 1, wherein the rear panel defines a height of about 21 inches and a width of about 21 inches, with the first and second arm apertures positioned about 3 inches from corresponding vertical edges of the rear panel and positioned at an approximate vertical midpoint of the height of the rear panel.

13. A personal pop-up pod comprising:

an interior chamber formed by a connection of a front panel, a rear panel, a left side panel, a right side panel, and a top panel, the interior chamber also being bounded by an open bottom opposite the top panel;

a first arm aperture formed in the rear panel; and a second arm aperture formed in the rear panel, wherein a bottom edge of the front panel includes an elastic strip positioned along the bottom edge such that the bottom edge of the front panel may closely conform around a neck or shoulder region of a patient when the personal pop-up pod is placed such that the interior chamber is on top of and encloses the patient's head, and the first arm aperture comprises:

a first flap of material secured to the rear panel and including a first edge and a first elastic member secured along the first edge;

a second flap of material secured to the rear panel proximate to the first flap of material and including a second edge and a second elastic member secured along the second edge; and a first slit formed between the first edge and the second edge; and the second arm aperture comprises:

a third flap of material secured to the rear panel and including a third edge and a third elastic member secured along the third edge;

a fourth flap of material secured to the rear panel proximate to the third flap of material and including a fourth edge and a fourth elastic member secured along the fourth edge; and a second slit formed between the third edge and the fourth edge.

14. The personal pop-up pod of claim 13, wherein when a user places an arm through the first slit, the first and second elastic members conform to the user's arm; and when the user places an arm through the second slit, the third and fourth elastic members conform to the user's arm.

15. A method for controlling spread of communicable diseases when a medical caregiver treats a patient, the method comprising:

providing a personal pop-up pod before initiating treatment of the patient, the personal pop-up pod comprising:

an interior chamber formed by a connection of a front panel, a rear panel, a left side panel, a right side panel, and a top panel, the interior chamber also being bounded by an open bottom opposite the top panel;

a first arm aperture formed in the rear panel;

a second arm aperture formed in the rear panel; and an elastic strip positioned along a bottom edge of the front panel;

installing the personal pop-up pod over a head of the patient by laying the personal pop-up pod over the patient's head at the open bottom, and such that the bottom edge of the front panel closely conforms around a neck or shoulder region of the patient;

maintaining the personal pop-up pod in position over the patient's head during treatment of the patient to resist transmissions of airborne pathogens from the patient to the medical caregiver, wherein the medical caregiver accesses the patient using at least the first and second arm apertures;

selectively opening one or more windows provided by flaps of material and zipper closures provided in one or more of the left side panel, the right side panel, and the top panel, wherein each of the windows is larger in size than openings defined in the first and second arm apertures; and accessing the interior chamber with larger size medical devices and instruments via insertion through the one or more windows when opened, to thereby treat the patient in the interior chamber with these larger size medical devices and instruments.

16. The method of claim 15, further comprising:

applying a vacuum with a negative pressure device operatively connected to a port located in one of the panels defining the interior chamber, the negative pressure device selectively drawing air from the interior chamber to evacuate airborne pathogens from the patient being treated while also drawing flow of air towards the interior chamber through any openings in the panels, including those defined in the first and second arm apertures and in the one or more windows.

* * * * *